US011059144B2

(12) United States Patent
Nabeya

(10) Patent No.: US 11,059,144 B2
(45) Date of Patent: Jul. 13, 2021

(54) POLISHING APPARATUS

(71) Applicant: EBARA CORPORATION, Tokyo (JP)

(72) Inventor: Osamu Nabeya, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 140 days.

(21) Appl. No.: 15/799,582

(22) Filed: Oct. 31, 2017

(65) Prior Publication Data

US 2018/0065228 A1 Mar. 8, 2018

Related U.S. Application Data

(62) Division of application No. 14/710,535, filed on May 12, 2015, now Pat. No. 9,833,875.

(30) Foreign Application Priority Data

May 14, 2014 (JP) ..... 2014-100381
May 14, 2014 (JP) ..... 2014-100382

(51) Int. Cl.
*B24B 37/32* (2012.01)
*B24B 37/10* (2012.01)
(Continued)

(52) U.S. Cl.
CPC ..... *B24B 37/32* (2013.01); *B24B 37/107* (2013.01); *B24B 37/30* (2013.01); *B24B 41/007* (2013.01)

(58) Field of Classification Search
CPC ..... B24B 37/32; B24B 37/20; B24B 37/005; B24B 37/105; B24B 37/102
See application file for complete search history.

(56) References Cited

U.S. PATENT DOCUMENTS 5,476,414 A * 12/1995 Hirose ..... B24B 37/107 451/288
5,584,746 A * 12/1996 Tanaka ..... B24B 37/30 451/288
(Continued)

FOREIGN PATENT DOCUMENTS

CN 1440321 A 9/2003
CN 103447939 A 12/2013
(Continued)

OTHER PUBLICATIONS

Singapore Patent Application No. 10201503514T; Search Report; dated Nov. 30, 2017; 3 pages.

*Primary Examiner* — Orlando E Aviles
*Assistant Examiner* — Joel D Crandall
(74) *Attorney, Agent, or Firm* — BakerHostetler

(57) ABSTRACT

A polishing apparatus capable of preventing wear of rollers which are to transmit a load to a retainer ring and capable of preventing wear particles from escaping outside is disclosed. The polishing apparatus includes: a retainer ring disposed so as to surround the substrate and configured to press the polishing surface while rotating together with a head body; a rotary ring secured to the retainer ring and configured to rotate together with the retainer ring; a stationary ring disposed on the rotary ring; and a local-load exerting device configured to apply a local load to a part of the retainer ring through the rotary ring and the stationary ring. The rotary ring has rollers which are in contact with the stationary ring.

8 Claims, 25 Drawing Sheets

(51) Int. Cl.
*B24B 41/00* (2006.01)
*B24B 37/30* (2012.01)

(56) References Cited

U.S. PATENT DOCUMENTS

| | | | | | |
|---|---|---|---|---|---|
| 6,019,868 | A * | 2/2000 | Kimura | B24B 37/32 | 156/345.14 |
| 6,110,025 | A * | 8/2000 | Williams | B24B 49/16 | 451/286 |
| 6,220,945 | B1 * | 4/2001 | Hirokawa | B24B 7/228 | 451/287 |
| 6,354,907 | B1 * | 3/2002 | Satoh | B24B 37/005 | 451/10 |
| 6,428,399 | B1 * | 8/2002 | Tanabe | B24B 37/04 | 451/66 |
| 6,540,592 | B1 * | 4/2003 | Schultz | B24B 37/30 | 451/285 |
| 8,267,746 | B2 | 9/2012 | Yasuda et al. | | |
| 8,485,866 | B2 | 7/2013 | Yasuda et al. | | |
| 2001/0012751 | A1 | 8/2001 | Boyd et al. | | |
| 2013/0324012 | A1 * | 12/2013 | Fukushima | B24B 37/042 | 451/1 |
| 2014/0370794 | A1 | 12/2014 | Fukushima et al. | | |

FOREIGN PATENT DOCUMENTS

| | | | |
|---|---|---|---|
| JP | H02-257628 | A | 10/1990 |
| JP | H05-069310 | A | 3/1993 |
| JP | H06-262514 | A | 9/1994 |
| JP | H08-174404 | A | 7/1996 |
| JP | 2014-004675 | A | 1/2014 |
| WO | WO 2001/087541 | A2 | 11/2001 |

* cited by examiner

PRIOR ART

PRIOR ART

PRIOR ART

PRIOR ART

POLISHING APPARATUS

CROSS REFERENCE TO RELATED APPLICATIONS

This application is a divisional of U.S. application Ser. No. 14/710,535, filed May 12, 2015, which claims priority to Japanese Patent Application Number 2014-100381, filed May 14, 2014 and Japanese Patent Application Number 2014-100382, filed May 14, 2014, the entire contents of which are hereby incorporated by reference.

BACKGROUND

With a recent trend toward higher integration and higher density in semiconductor devices, circuit interconnects become finer and finer and the number of levels in multilayer interconnect is increasing. In the fabrication process of the multilayer interconnects with finer circuit, as the number of interconnect levels increases, film coverage (or step coverage) of step geometry is lowered in thin film formation because surface steps grow while following surface irregularities on a lower layer. Therefore, in order to fabricate the multilayer interconnects, it is necessary to improve the step coverage and planarize the surface. It is also necessary to planarize semiconductor device surfaces so that irregularity steps formed thereon fall within a depth of focus in optical lithography. This is because finer optical lithography entails shallower depth of focus.

Accordingly, the planarization of the semiconductor device surfaces is becoming more important in the fabrication process of the semiconductor devices. Chemical mechanical polishing (CMP) is the most important technique in the surface planarization. This chemical mechanical polishing is a process of polishing a wafer by bringing a wafer into sliding contact with a polishing surface of a polishing pad while supplying a polishing liquid containing abrasive grains, such as silica ($SiO_2$), onto the polishing surface.

FIG. 22 is a schematic view of a polishing apparatus for performing CMP. This polishing apparatus includes a polishing table 203 for supporting a polishing pad 202, a polishing head 201 for holding a wafer W, and a polishing liquid supply nozzle 205 for supplying a polishing liquid (or slurry) onto the polishing pad 202. The polishing pad 202 is rotated together with the polishing table 203, while the polishing liquid is supplied onto the rotating polishing pad 202. The polishing head 201 holds the wafer W and presses the wafer W against a polishing surface 202*a* of the polishing pad 202 at predetermined pressure. A surface of the wafer W is polished by a mechanical action of abrasive grains contained in the polishing liquid and a chemical action of chemical components contained in the polishing liquid.

If a relative pressing force applied between the wafer W and the polishing surface 202*a* of the polishing pad 202 is not uniform over the entire surface of the wafer W during polishing, the surface of the wafer W is polished insufficiently or excessively in different regions thereof, which depends on pressing force applied thereto. It has been customary to uniformize the pressing force applied to the wafer W by providing a pressure chamber formed by an elastic membrane at a lower portion of the polishing head 201 and supplying the pressure chamber with a fluid, such as air, to press the wafer W under a fluid pressure through the elastic membrane.

The polishing pad 202 is so elastic that pressing forces applied to an edge portion (or a peripheral portion) of the wafer W become non-uniform during polishing, and hence only the edge portion of the wafer W may excessively be polished, which is referred to as "edge rounding". In order to prevent such edge rounding, a retainer ring 220 for holding the edge portion of the wafer W is provided so as to be vertically movable with respect to a head body to thereby press the polishing surface 202*a* of the polishing pad 202 in an area around the peripheral portion of the wafer W.

Since the retainer ring 220 presses the polishing pad 202 in an area around the wafer W, a load of the retainer ring 220 affects a profile of the edge portion of the wafer W. In order to positively control a profile of the edge portion of the wafer W, a local load may be applied to a part of the retainer ring 220. The polishing apparatus shown in FIG. 22 is provided with a local-load exerting device 230 for exerting a local load on a part of the retainer ring 220. This local-load exerting device 230 is secured to a head arm 216.

FIG. 23 is a perspective view of the local-load exerting device 230 and the polishing head 201. As shown in FIG. 23, a stationary ring 235 is disposed on the retainer ring 220. The local-load exerting device 230 has a push rod 231 for transmitting a downward load to the retainer ring 220. The lower end of the push rod 231 is secured to the stationary ring 235. While the retainer ring 220 rotates during polishing of the wafer W, the stationary ring 235 and the local-load exerting device 230 do not rotate. The stationary ring 235 has the below-described rollers which make rolling contact with the upper surface of the retainer ring 220. The local-load exerting device 230 transmits a downward local load from the push rod 231 to the retainer ring 220 through the stationary ring 235.

FIG. 24 is a diagram, as viewed from above the retainer ring 220, of a mechanism for applying the local load to a part of the retainer ring 220. As shown in FIG. 24, a circular rail 221 is fixed to an upper surface of the retainer ring 220, and three rollers 225 are disposed on the circular rail 221. An annular groove 221*a* is formed in an upper surface of the circular rail 221, and the rollers 225 are placed in this annular groove 221*a*.

FIG. 25 is a perspective view of the circular rail 221 and the rollers 225 disposed on it. The depiction of the retainer ring 220 has been omitted from FIG. 25. One of the three rollers 225 is coupled to the local-load exerting device 230 and, as shown in FIG. 25, a downward local load is exerted on this roller 225. The circular rail 221 rotates together with the retainer ring 220 during polishing of a wafer, while the three rollers 225 are each kept in a fixed position. Accordingly, these rollers 225 make rolling contact with the rotating circular rail 221.

When the circular rail 221 is rotating together with the retainer ring 220, there is a difference in speed between an inner side and an outer side of each roller 225 because the circular rail 221 has an annular shape as a whole. Accordingly, each roller 225 slips slightly due to the difference in speed. Further, when the circular rail 221 is rotating, the side surfaces of each roller 225 make contact with the annular groove 221*a* of the circular rail 221. Due to such slippage and contact of the rollers 225, the rollers 225 wear and thereby may generate wear particles. Moreover, the rollers 225 can break as their wear progresses. If the wear particles fall on the polishing pad, such wear particles may scratch the surface of the wafer during polishing of the wafer, thus causing a defect in the wafer.

The rotating retainer ring 220 may tilt due to manufacturing accuracy and surface irregularities of the polishing pad 202. Since the push rod 231 is secured to the stationary ring 235, the push rod 231 also tilts as the retainer ring 220 tilts. When the push rod 231 tilts, an excessive frictional resistance may be generated in a linear guide (not shown) that supports the push rod 231, resulting in a failure to apply an intended local load to the retainer ring 220. This may result in a failure to obtain a desired polishing result, and may cause a variation in thickness of a film especially in the peripheral portion of the wafer W.

Further, the local-load exerting device 230 may be slightly inclined with respect to the retainer ring 220 upon fixing of the local-load exerting device 230 to the head arm 216. If the local-load exerting device 230 itself is inclined with respect to the retainer ring 220, a stress is applied to the push rod 231 in a direction other than the vertical direction, whereby an excessive frictional resistance is generated in the above-described linear guide (not shown). This may also result in a failure to obtain a desired polishing result, and may cause a variation in thickness of a film especially in the peripheral portion of the wafer W.

In addition, when the polishing table 203 is rotating, the surface of the polishing table 203 may fluctuate up and down. Such a fluctuation of the polishing table 203 in the vertical directions may cause the entire retainer ring 220 to vibrate vertically. The local-load exerting device 230, which has its frictional resistance and large inertia, cannot absorb the vibration of the retainer ring 220, and as a result, the local load on the retainer ring 220 may also fluctuate.

SUMMARY OF THE INVENTION

According to an embodiment, there is provided a polishing apparatus capable of preventing wear of rollers which are to transmit a load to a retainer ring.

According to an embodiment, there is provided a polishing apparatus capable of enabling a local-load exerting device to exert an intended local load on a retainer ring even when the local-load exerting device and the retainer ring tilt relative to each other.

Embodiments, which will be described later, relate to a polishing apparatus for polishing a substrate, such as a wafer, and more particularly to a polishing apparatus including a retainer ring for surrounding a circumference of the substrate.

In an embodiment, there is provided a polishing apparatus comprising: a head body configured to press a substrate against a polishing surface while rotating the substrate; a retainer ring disposed so as to surround the substrate and configured to press the polishing surface while rotating together with the head body; a rotary ring secured to the retainer ring and configured to rotate together with the retainer ring; a stationary ring disposed on the rotary ring; and a local-load exerting device configured to apply a local load to a part of the retainer ring through the rotary ring and the stationary ring, the rotary ring having rollers which are in contact with the stationary ring.

In an embodiment, each of the rollers includes a bearing, and a wheel mounted to an outer race of the bearing, the wheel being formed of resin or rubber.

In an embodiment, the rotary ring includes a roller housing having an annular recess in which the rollers are housed.

In an embodiment, the polishing apparatus further comprises a suction line coupled to the stationary ring, the suction line communicating with a space formed by the annular recess.

In an embodiment, the polishing apparatus further comprises a seal provided between the rotary ring and the stationary ring.

In an embodiment, the seal comprises a labyrinth seal.

In an embodiment, the seal comprises a contact-type seal that closes a gap between the rotary ring and the stationary ring.

In an embodiment, the stationary ring includes a circular rail which is in contact with the rollers.

According to the above-described embodiments, the rollers transmit a load to a part of the retainer ring while the rollers are rotating together with the retainer ring. Each roller receives the load only when the roller passes a point at which the load is applied. Therefore, each roller receives the load for a short time, and as a result, wear of the rollers can be reduced. Moreover, generation of wear particles is prevented, and a life of each roller increases.

In an embodiment, there is provided a polishing apparatus comprising: a head body configured to press a substrate against a polishing surface while rotating the substrate; a retainer ring disposed so as to surround the substrate and configured to press the polishing surface while rotating together with the head body; a stationary ring disposed above the retainer ring; and a local-load exerting device configured to apply a local load to a part of the retainer ring through the stationary ring, the local-load exerting device having a load transmission structure coupled to the stationary ring, the load transmission structure including a mechanism which permits a relative inclination between the local-load exerting device and the retainer ring.

In an embodiment, the mechanism is a tiltable coupling.

In an embodiment, the tiltable coupling can tilt only in a direction tangential to the retainer ring at a location where the load transmission structure is coupled to the stationary ring.

In an embodiment, the load transmission structure includes: a pressing member coupled to the stationary ring; and the tiltable coupling fixed to the pressing member.

In an embodiment, the tiltable coupling is configured to be able to tilt in multiple directions.

In an embodiment, the load transmission structure includes: two push rods for transmitting the local load; and two spherical bearings which tiltably support the two push rods, respectively, the tiltable coupling comprising the two spherical bearings.

In an embodiment, the two spherical bearings include: two bearing housings; and two projections which are in point contact with the two bearing housings, respectively.

In an embodiment, the load transmission structure further includes a vibration absorber.

In an embodiment, the vibration absorber comprises a spring.

In an embodiment, the vibration absorber is made of rubber.

Even when the local-load exerting device and the retainer ring tilt relative to each other due to some causes, such as surface irregularities of the polishing pad, the load transmission structure can absorb such a relative inclination between the local-load exerting device and the retainer ring. Therefore, unwanted force is not generated in the local-load exerting device and the retainer ring, and the local-load exerting device can therefore transmit a target local load to the retainer ring.

DESCRIPTION OF EMBODIMENTS

Figure 1:
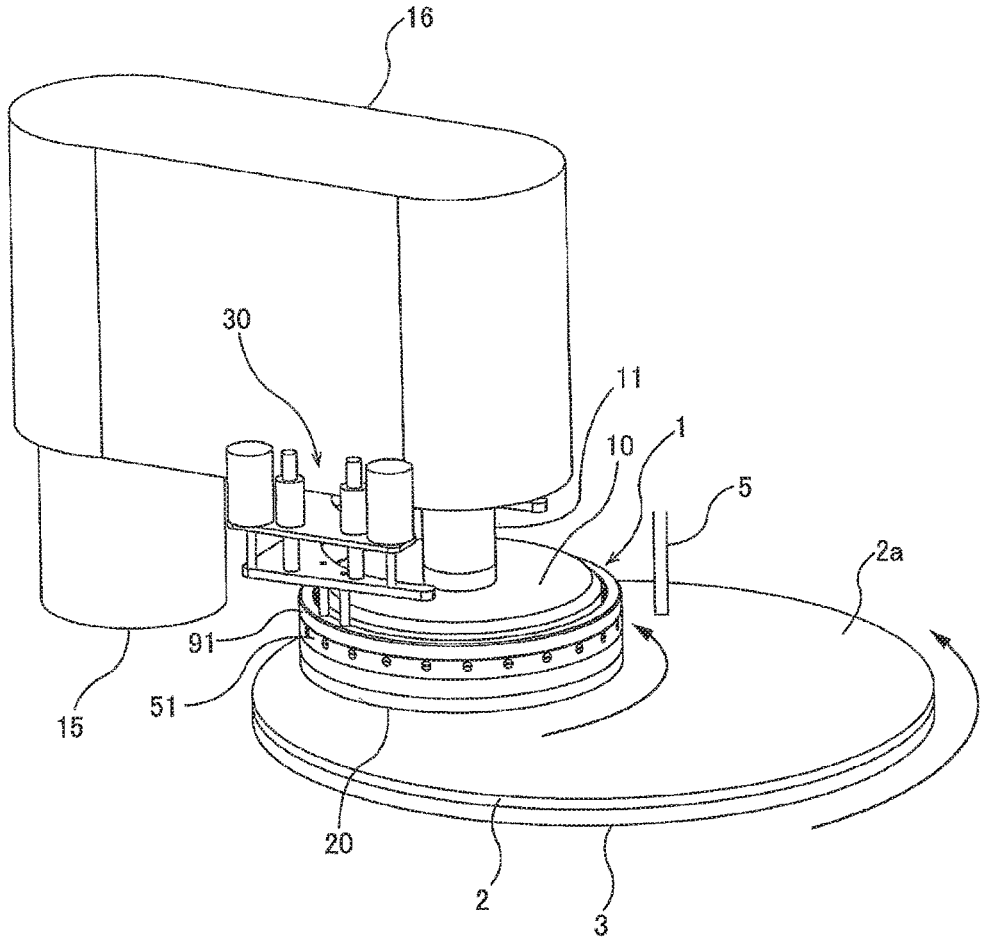
FIG. 1 is a schematic view of a polishing apparatus according to an embodiment.

Embodiments will be described in detail below with reference to the drawings. Identical or corresponding parts are denoted by the same reference numerals throughout the views and their repetitive explanations will be omitted.

FIG. 1 is a schematic view of a polishing apparatus according to an embodiment. As shown FIG. 1, the polishing apparatus includes a polishing head (or a substrate holder) 1 for holding and rotating a wafer which is an example of a substrate, a polishing table 3 for supporting a polishing pad 2 thereon, a polishing liquid supply nozzle 5 for supplying a polishing liquid (or slurry) onto the polishing pad 2. The polishing pad 2 has an upper surface which provides a polishing surface 2*a* for polishing the wafer.

The polishing head 1 is coupled to a lower end of a polishing head shaft 11, which is rotatably held by a head arm 16. In this head arm 16, there are disposed a rotating device (not shown in the drawings) for rotating the polishing head shaft 11 and an elevating device (not shown in the drawings) for elevating and lowering the polishing head shaft 11. The polishing head 1 is rotated by the rotating device through the polishing head shaft 11, and is elevated and lowered by the elevating device through the polishing head shaft 11. The head arm 16 is secured to a pivot shaft 15, so that the head arm 16 can move the polishing head 1 outwardly of the polishing table 3 as the pivot shaft 15 rotates.

The polishing head 1 is configured to hold a wafer on its lower surface by vacuum suction. The polishing head 1 and the polishing table 3 rotate in the same direction as indicated by arrows. In this state, the polishing head 1 presses the wafer against the polishing surface 2*a* of the polishing pad 2. The polishing liquid is supplied from the polishing liquid supply nozzle 5 onto the polishing pad 2, so that the wafer is polished by sliding contact with the polishing pad 2 in the presence of the polishing liquid.

The polishing head 1 includes a head body 10 for pressing the wafer against the polishing pad 2, and a retainer ring 20 arranged so as to surround the wafer. The head body 10 and the retainer ring 20 are rotatable together with the polishing head shaft 11. The retainer ring 20 is configured to be movable in the vertical directions independently of the head body 10. The retainer ring 20 projects radially outwardly from the head body 10. A local-load exerting device 30, which serves to exert a local load on a part of the retainer ring 20, is disposed above the retainer ring 20.

The local-load exerting device 30 is secured to the head arm 16. The retainer ring 20 rotates about its own axis during polishing of the wafer, while the local-load exerting device 30 does not rotate with the retainer ring 20 and its position is fixed. The retainer ring 20 has an upper surface to which a rotary ring 51 is secured. The rotary ring 51 has a plurality of roller rings (which will be discussed later) provided therein. A stationary ring 91 is placed on the rotary ring 51. The stationary ring 91 is coupled to the local-load exerting device 30.

The rotary ring 51 rotates together with the retainer ring 20, while the stationary ring 91 does not rotate and its position is fixed. The local-load exerting device 30 is configured to exert a downward local load on a part of the retainer ring 20 through the stationary ring 91 and the rotary ring 51. This downward local load is transmitted through the stationary ring 91 and the rotary ring 51 to the retainer ring 20, which presses the polishing surface 2*a* of the polishing pad 2. The reason for exerting the downward local load on a part of the retainer ring 20 during polishing of the wafer is to positively control a profile of the peripheral portion (edge portion) of the water.

Figure 2:
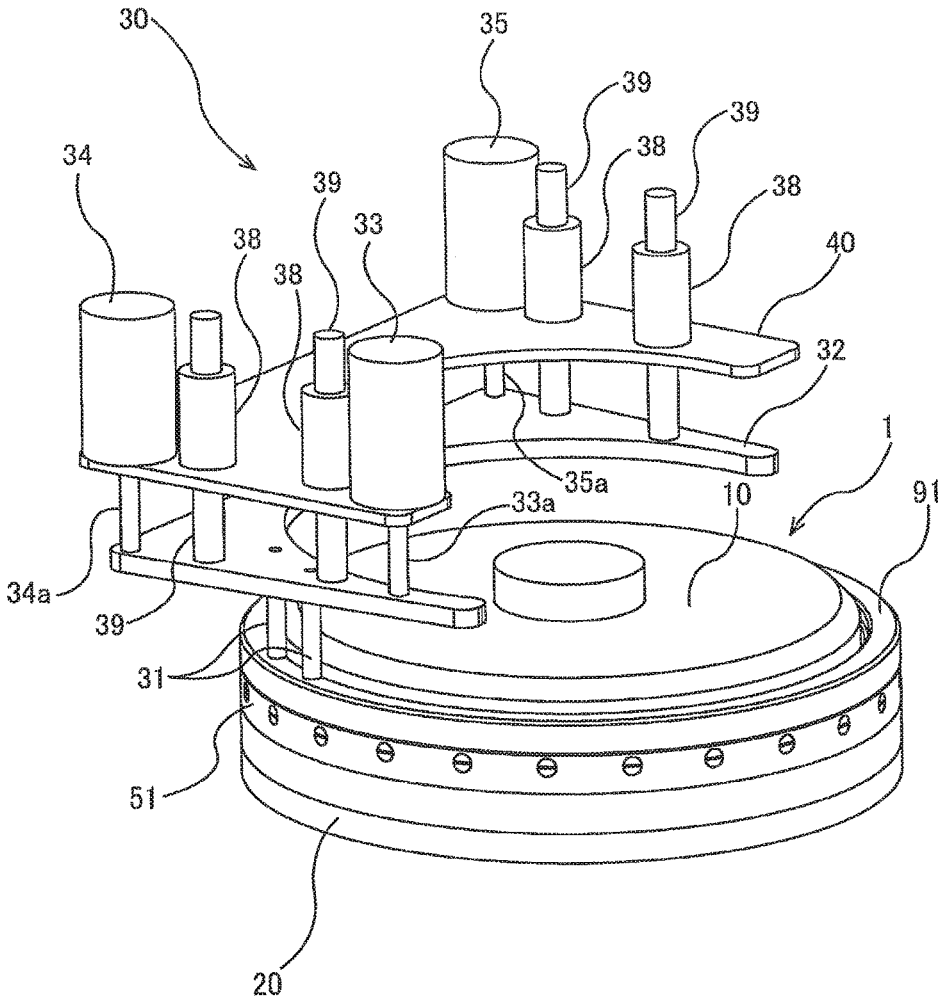
FIG. 2 is a perspective view of a local-load exerting device.

FIG. 2 is a perspective view of the local-load exerting device 30. As shown in FIG. 2, the local-load exerting device 30 includes two push rods 31, a bridge 32, a plurality of air cylinders (load generators) 33, 34, and 35, a plurality of linear guides 38, a plurality of guide rods 39, and a unit base 40.

The unit base 40 is secured to the head arm 16. The plurality of (three in the drawing) air cylinders 33, 34, and 35 and the plurality of (four in the drawing) linear guides 38 are mounted to the unit base 40. The air cylinders 33, 34 and 35 have piston rods 33*a*, 34*a*, and 35*a*, respectively. The piston rods 33*a*, 34*a*, and 35*a* and the guide rods 39 are coupled to the common bridge 32. The guide rods 39 are vertically movably supported by the respective linear guides 38 with low friction. Therefore, the linear guides 38 allow the bridge 32 to move smoothly in the vertical directions without being inclined.

The air cylinders 33, 34, and 35 are coupled respectively to pressure regulators (not shown) and air vent mechanisms (not shown), so that the air cylinders 33, 34, and 35 can generate loads independently of each other. The air cylinders 33, 34, and 35 generate loads that are transmitted to the common bridge 32. The bridge 32 is coupled to the stationary ring 91 through the push rods (pressing members) 31, which transmit the loads, applied from the air cylinders 33, 34, and 35 to the bridge 32, to the stationary ring 91. The reason for providing three air cylinders is to align a center of the loads of the air cylinders with the position of the local load by changing the proportion of outputs of the three air cylinders, because the local load is located under the head arm 16 and an air cylinder cannot be arranged right above the position of the local load. Three air cylinders are provided in this embodiment, while only a single air cylinder may be provided together with enhanced linear guide mechanisms or an air cylinder may be provided under the head arm 16.

While the polishing head 1 rotates about its own axis, the local-load exerting device 30 does not rotate with the polishing head 1 because the local-load exerting device 30 is secured to the head arm 16. Specifically, during polishing of the wafer, the polishing head 1 and the wafer rotate about their own axes, while the local-load exerting device 30 is stationary at a predetermined position. Similarly, during polishing of the wafer, the rotary ring 51 rotates together with the polishing head 1, while the stationary ring 91 is stationary at a predetermined position.

Figure 3:
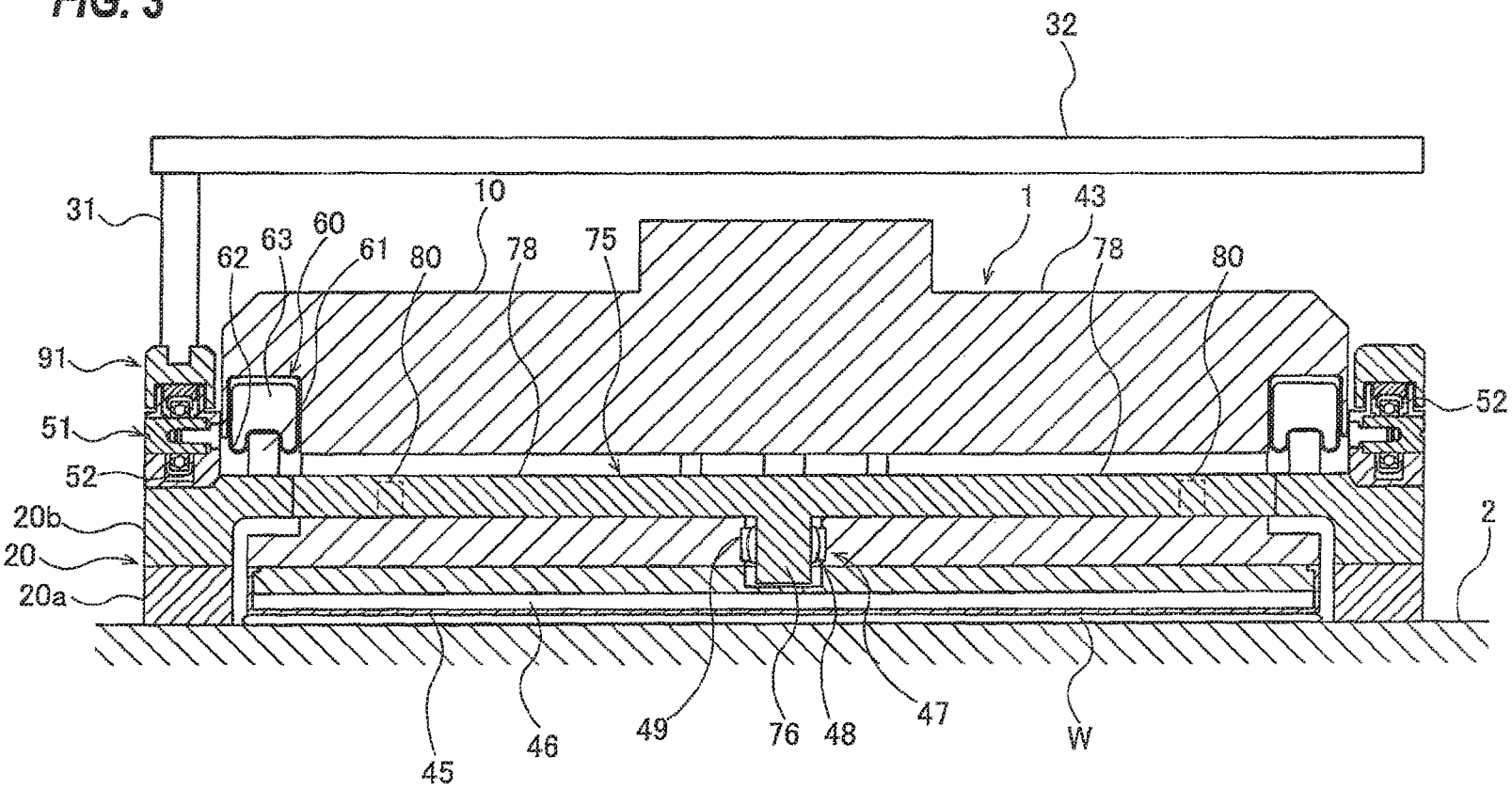
FIG. 3 is a cross-sectional view of a polishing head.

Next, the polishing head 1 as a substrate holder will be described. FIG. 3 is a cross-sectional view of the polishing head 1. This polishing head 1 includes the head body 10 and the retainer ring 20. The head body 10 includes a carrier 43 coupled to the polishing head shaft 11 (see FIG. 1), an elastic membrane (or a membrane) 45 attached to a lower surface of the carrier 43, and a spherical bearing 47 supporting the retainer ring 20 while allowing the retainer ring 20 to tilt and move in the vertical directions relative to the carrier 43. The retainer ring 20 is coupled to and supported by the spherical bearing 47 through a coupling member 75. This coupling member 75 is disposed in the carrier 43 and is vertically movable in the carrier 43.

The elastic membrane 45 has a lower surface that provides a substrate contact surface in a circular shape. This substrate contact surface is brought into contact with an upper surface (a surface opposite to a surface to be polished) of the wafer W. The substrate contact surface of the elastic membrane 45 has through-holes (not shown). A pressure chamber 46 is formed between the carrier 43 and the elastic membrane 45. This pressure chamber 46 is in a fluid communication with a pressure regulator (not shown). When a pressurized fluid (e.g., a pressurized air) is supplied into the pressure chamber 46, the elastic membrane 45 receives the pressure of the fluid in the pressure chamber 46, thus pressing the wafer W against the polishing surface 2*a* of the polishing pad 2. When negative pressure is developed in the pressure chamber 46, the wafer W is held on the lower surface of the elastic membrane 45 by the vacuum suction.

The retainer ring 20 is arranged so as to surround the wafer W and the elastic membrane 45. The retainer ring 20 has a ring member 20*a* that is to touch the polishing pad 2, and a drive ring 20*b* fixed to an upper portion of the ring member 20*a*. The ring member 20*a* is secured to the drive ring 20*b* by a plurality of bolts (now shown). The ring member 20*a* is arranged so as to surround a peripheral edge of the wafer W.

The coupling member 75 includes a shaft portion 76 located in the center of the head body 10, and spokes 78 extending radially from the shaft portion 76. The shaft portion 76 extends in the vertical direction through the spherical bearing 47 that is located in the center of the head body 10. The shaft portion 76 is supported by the spherical bearing 47 such that the shaft portion 76 can be movable in the vertical directions. The drive ring 20*b* is connected the spokes 78. With these configurations, the coupling member 75 and the retainer ring 20, which is coupled to the coupling member 75, can move relative to the head body 10 in the vertical directions.

The spherical bearing 47 includes an inner race 48, and an outer race 49 that slidably supports an outer circumferential surface of the inner race 48. The inner race 48 is coupled to the retainer ring 20 through the coupling member 75. The outer race 49 is fixed to the carrier 43. The shaft portion 76 of the coupling member 75 is supported by the inner race 48 such that the shaft portion 76 can move in the vertical directions. The retainer ring 20 is tiltably supported by the spherical bearing 47 through the coupling member 75.

The spherical bearing 47 is configured to allow the retainer ring 20 to move in the vertical directions and tilt, while restricting a lateral movement (horizontal movement) of the retainer ring 20. During polishing of the wafer W, the retainer ring 20 receives from the wafer W a lateral force (an outward force in the radial direction of the wafer W) that is generated due to the friction between the wafer W and the polishing pad 2. This lateral force is bore or received by the spherical bearing 47. In this manner, the spherical bearing 47 serves as a bearing device configured to receive the lateral force (the outward force in the radial direction of the wafer W) that is applied from the wafer W to the retainer ring 20 due to the friction between the wafer W and the polishing pad 2 during polishing of the wafer W, while restricting the lateral movement of the retainer ring 20 (i.e., fixing the horizontal position of the retainer ring 20).

Plural pairs of drive collars 80 are fixed to the carrier 43. Each pair of drive collars 80 are arranged on both sides of each spoke 78. The rotation of the carrier 43 is transmitted through the drive collars 80 to the retainer ring 20, so that the head body 10 and the retainer ring 20 can rotate together. The drive collars 80 are just in contact with the spokes 78 and do not prevent the vertical movement and the tilt of the coupling member 75 and the retainer ring 20.

The upper portion of the retainer ring 20 is coupled to an annular retainer ring pressing mechanism 60, which is configured to exert a uniform downward load on an entire upper surface of the retainer ring 20 (more specifically, an upper surface of the drive ring 20*b*) to thereby press a lower surface of the retainer ring 20 (i.e., a lower surface of the ring member 20*a*) against the polishing surface 2*a* of the polishing pad 2.

The retainer ring pressing mechanism 60 includes an annular piston 61 secured to the upper portion of the drive ring 20*b*, and an annular rolling diaphragm 62 connected to an upper surface of the piston 61. The rolling diaphragm 62 forms a pressure chamber 63 therein. This pressure chamber 63 is coupled to the pressure regulator (not shown). When a pressurized fluid (e.g., pressurized air) is supplied into the pressure chamber 63, the rolling diaphragm 62 pushes down the piston 61, which in turn pushes down the entirety of the retainer ring 20. In this manner, the retainer ring pressing mechanism 60 presses the lower surface of the retainer ring 20 against the polishing surface 2*a* of the polishing pad 2.

The rotary ring 51 is fixed to the upper surface of the retainer ring 20. The stationary ring 91 is disposed on the rotary ring 51. Lower ends of the push rods 31 of the local-load exerting device 30 are coupled to the stationary ring 91. The local-load exerting device 30 applies a downward local load to the stationary ring 91 through the push rods 31. During polishing of the wafer, the rotary ring 51 rotates together with the retainer ring 20, while the local-load exerting device 30 and the stationary ring 91 do not rotate.

Figure 4:
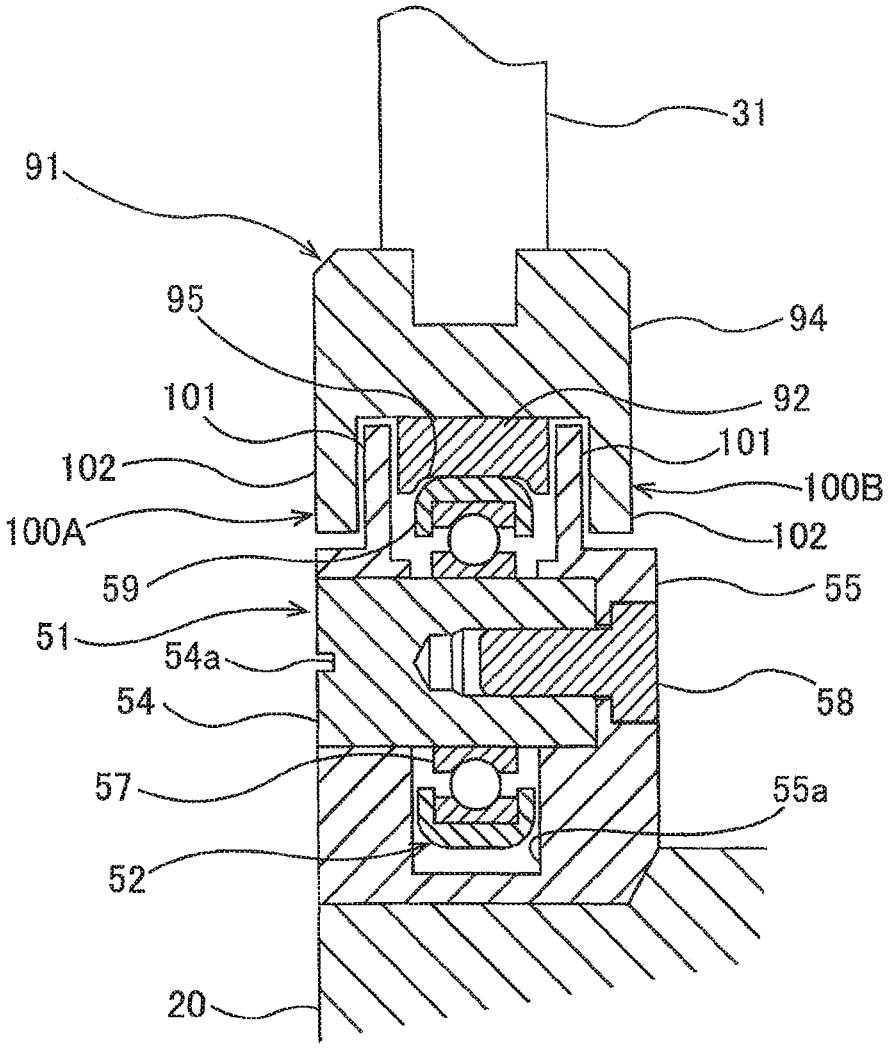
FIG. 4 is a cross-sectional view of a rotary ring and a stationary ring.

FIG. 4 is a cross-sectional view of the rotary ring 51 and the stationary ring 91. The rotary ring 51 includes a plurality of rollers 52, roller shafts 54 that support the rollers 52 respectively, and a roller housing 55 to which the roller shafts 54 are fixed. The roller housing 55 has an annular shape and is fixed to the upper surface of the retainer ring 20. Each roller 52 has a bearing 57 mounted to the roller shaft 54 so that the roller 52 can rotate around the roller shaft 54.

The stationary ring 91 includes a circular rail 92 which is in contact with tops of the rollers 52, and an annular rail base 94 to which the circular rail 92 is fixed. An annular groove 95 is formed in a lower surface of the circular rail 92, and the tops of the rollers 52 are in contact with the annular groove 95. The push rods 31 are coupled to the top portion of the rail base 94.

Figure 5:
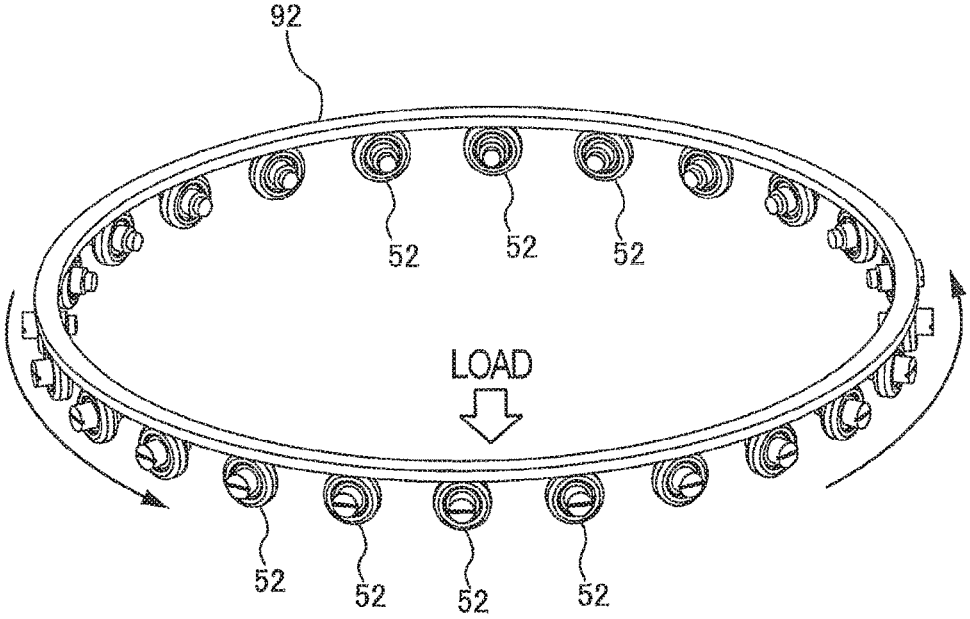
FIG. 5 is a perspective view of rollers and a circular rail.
Figure 6:
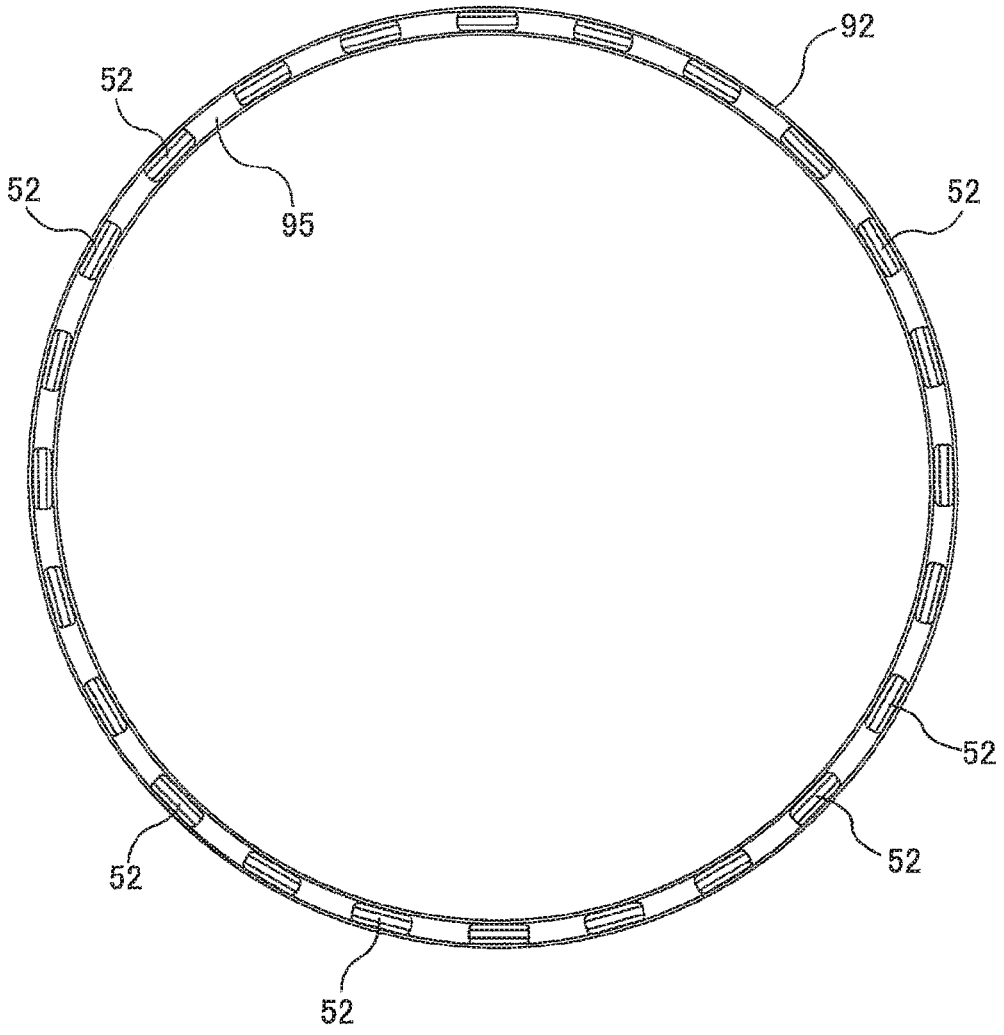
FIG. 6 is a diagram of the rollers and the circular rail shown in FIG. 5, as viewed from below.

FIG. 5 is a perspective view of the rollers 52 and the circular rail 92, and FIG. 6 is a diagram of the rollers 52 and the circular rail 92 of FIG. 5, as viewed from below. In this embodiment the rotary ring 51 has 24 rollers 52. During polishing of a wafer, the rollers 52 rotate together with the retainer ring 20, while the circular rail 92 remains stationary. Accordingly, the rollers 52 make rolling contact with the circular rail 92.

Figure 24:
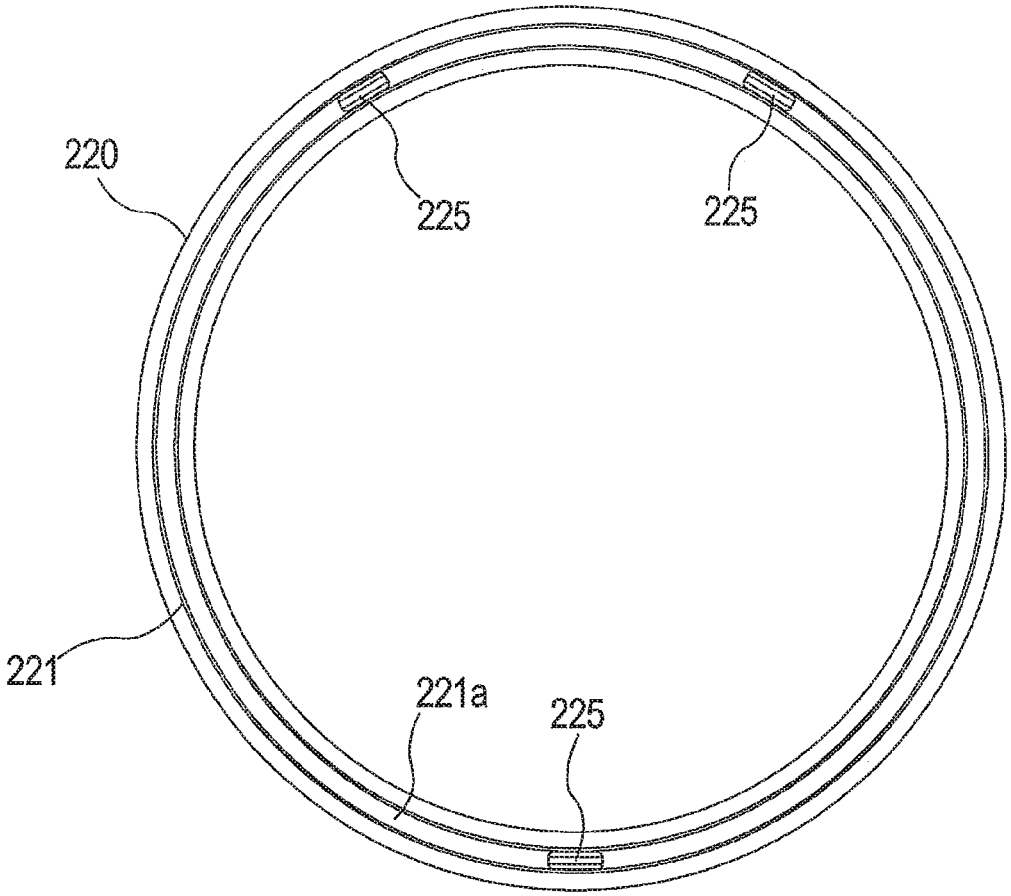
FIG. 24 is a diagram, as viewed from above a retainer ring, of a mechanism for applying a local load to a part of the retainer ring.
Figure 25:
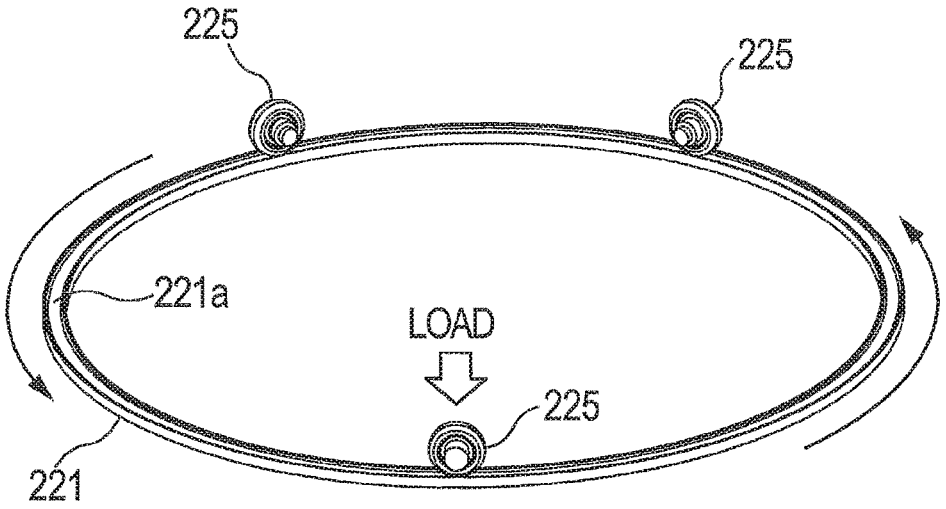
FIG. 25 is a perspective view of a circular rail and rollers arranged on it.

The load of the local-load exerting device 30 is transmitted from the circular rail 92 to the rollers 52. Each roller 52 receives the load of the local-load exerting device 30 only when the roller 52 passes a point of application of the load. Therefore, a time during which the load is applied to each roller 52 is short as compared to the conventional construction, shown in FIG. 24, in which the positions of the rollers are fixed. The life of each roller 52 can therefore increase.

The number of rollers 52 is determined based on the diameter of the roller 52 and the diameter of the circular rail 92. To achieve a smooth transmission of the load, it is preferred to use as many rollers 52 as possible so as to minimize a distance between adjacent rollers 52. Each roller 52 has a smooth circumferential surface, and is in contact with the circular rail 92 in a wide contact area so that the roller 52 can transmit a larger load. The circular rail 92 is placed on the rollers 52. The rollers 52 make rolling contact with the circular rail 92. A lateral position of the circular rail 92 is guided by contact between a corner, having a curved cross-sectional shape, of each roller 52 and a corner, having a curved cross-sectional shape, of the circular rail 92. The load of the local-load exerting device 30 is mainly transmitted from the circular rail 92 to the circumferential surface of each roller 52.

As shown in FIG. 4, the roller shaft 54 that extends through an inner race of the bearing 57 of each roller 52 is supported by an inner wall and an outer wall of the roller housing 55 and is fixed by a screw 58 inserted into the inner wall. Thus, a female screw is formed in the roller shaft 54, and a groove 54*a*, into which a flathead screwdriver fits to avoid free spinning of the screw 58 upon tightening of it, is formed on the opposite side of the screw 58 from the female screw. The rotary ring 51 is placed on the upper surface of the drive ring 20*b* of the retainer ring 20. The drive ring 20*b* and the rotary ring 51 are positioned by positioning pins (not shown) so that the rotary ring 51 does not slip relative to the retainer ring 20.

Each roller 52 includes the bearing 57 mounted to the roller shaft 54, and a wheel 59 secured to an outer race of the bearing 57. The wheel 59 is formed of a resin having a high abrasion resistance, such as polyacetal, PET (polyethylene terephthalate), PPS (polyethylene sulfide), or MC Nylon (registered trademark). The circular rail 92 is preferably formed of a metal having a high corrosion resistance, such as stainless steel (SUS 304). A single-row deep-groove ball bearing is used as the bearing 57. The wheel 59 is mounted to the bearing 57 by pressing the outer race of the bearing 57 into the resin wheel 59. With such a construction, the roller 52 can rotate smoothly and can transmit a load without damaging the circular rail 92.

An annular recess 55*a* is formed in the roller housing 55, and the multiple rollers 52 are housed in this annular recess 55*a*. The lower surface and both side surfaces of each roller 52 are surrounded by the annular recess 55*a*. Seals 100A, 100B are disposed between the roller housing 55 of the rotary ring 51 and the rail base 94 of the stationary ring 91. More specifically, the outer seal 100A is located outside the circular rail 92, and the inner seal 100B is located inside the circular rail 92. There is no opening in both side surfaces and a bottom surface that form the annular recess 55*a*, and the seals 100A, 100B are provided between the stationary ring 91 and the rotary ring 51. Therefore, wear particles, generated from the rollers 52 and the circular rail 92, are confined in the annular recess 55*a* and do not fall on the polishing pad 2.

In the embodiment illustrated in FIG. 4, the outer seal 100A and the inner seal 100B are labyrinth seals. The outer seal 100A includes a first circumferential wall 101 located outside the circular rail 92, and a second circumferential wall 102 located outside the first circumferential wall 101. The first circumferential wall 101 extends upward from the roller housing 55 and is formed integrally with the roller housing 55. The second circumferential wall 102 extends downward from the rail base 94 and is formed integrally with the rail base 94. A very small gap is formed between the first circumferential wall 101 and the second circumferential wall 102. Likewise, the inner seal 100B includes a first circumferential wall 101 located inside the circular rail 92, and a second circumferential wall 102 located inside the first circumferential wall 101.

Figure 7:
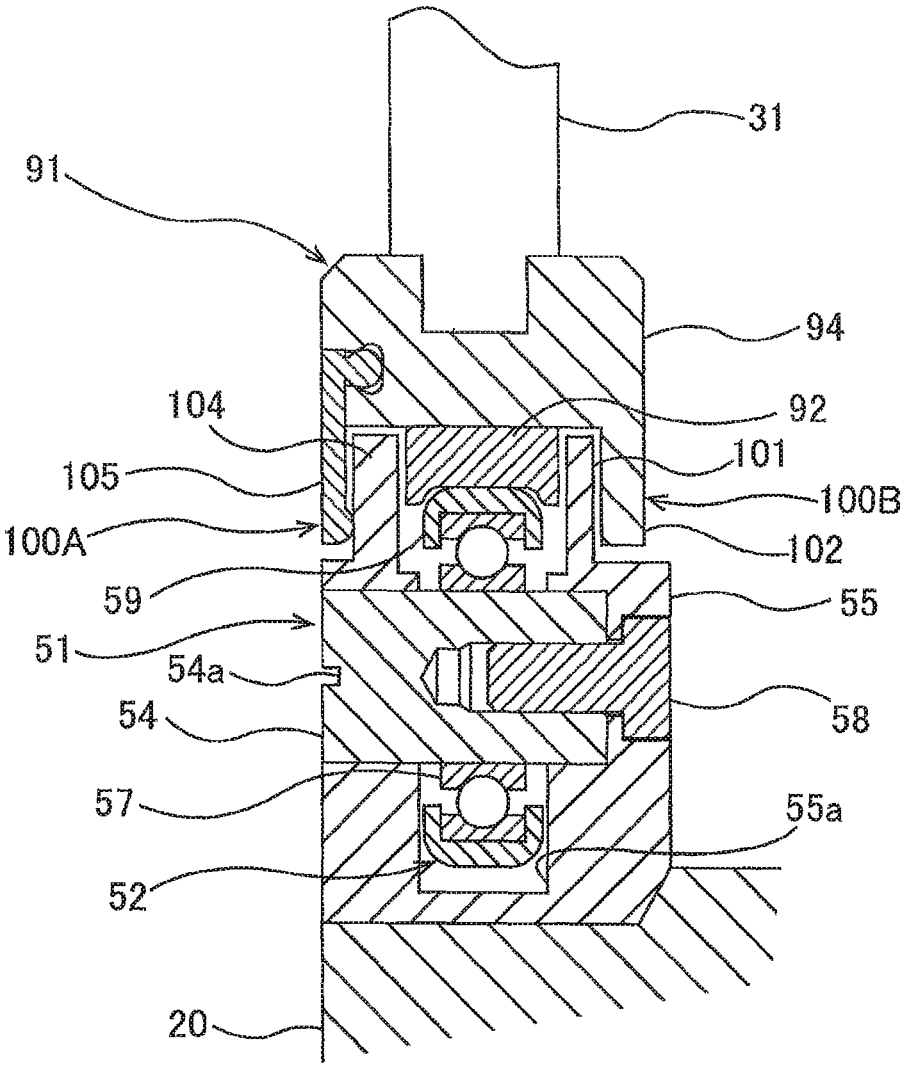
FIG. 7 is a cross-sectional view of a contact-type seal.

In another embodiment, as shown in FIG. 7, the outer seal 100A may be a contact-type seal that closes the gap between the stationary ring 91 and the rotary ring 51. This contact-type seal includes a circumferential wall 104 located outside the circular rail 92, and a lip seal 105 located outside the circumferential wall 104. The circumferential wall 104 extends upward from the roller housing 55 and is formed integrally with the roller housing 55. The lip seal 105 extends downward from the rail base 94, and is formed of an elastic material, such as rubber or silicone. An end portion of the lip seal 105 is in contact with the circumferential wall 104. Thus, there is no gap between the circumferential wall 104 and the lip seal 105, whereby the wear particles are completely prevented from escaping from the annular recess 55*a*. Not only the outer seal 100A, but also the inner seal 100B may be a contact-type seal.

Figure 8:
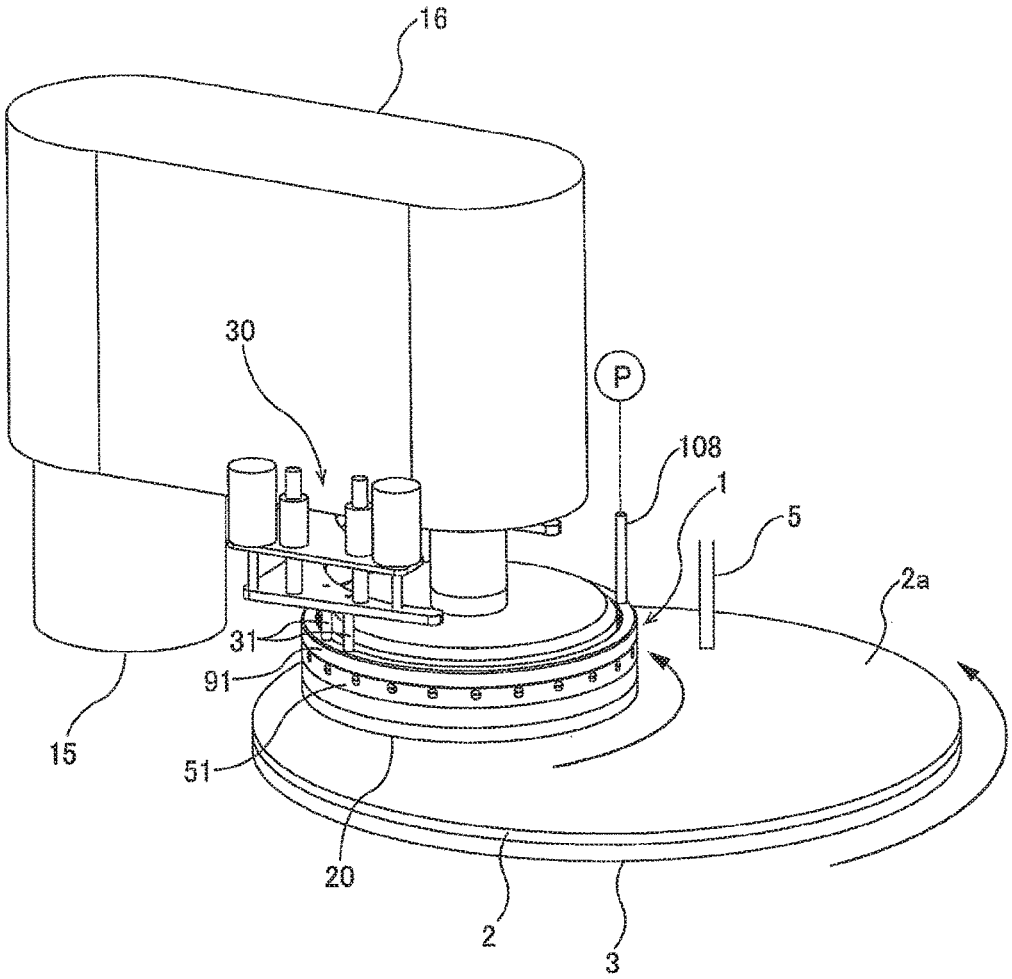
FIG. 8 a view showing a suction system for sucking wear particles from the polishing head.

A suction system for sucking the wear particles from the polishing head 1 will now be described with reference to FIG. 8. As shown in FIG. 8, the polishing apparatus includes a suction line 108 connected to a vacuum source (e.g., a vacuum pump) P. A distal end of the suction line 108 is coupled to the stationary ring 91.

Figure 9:
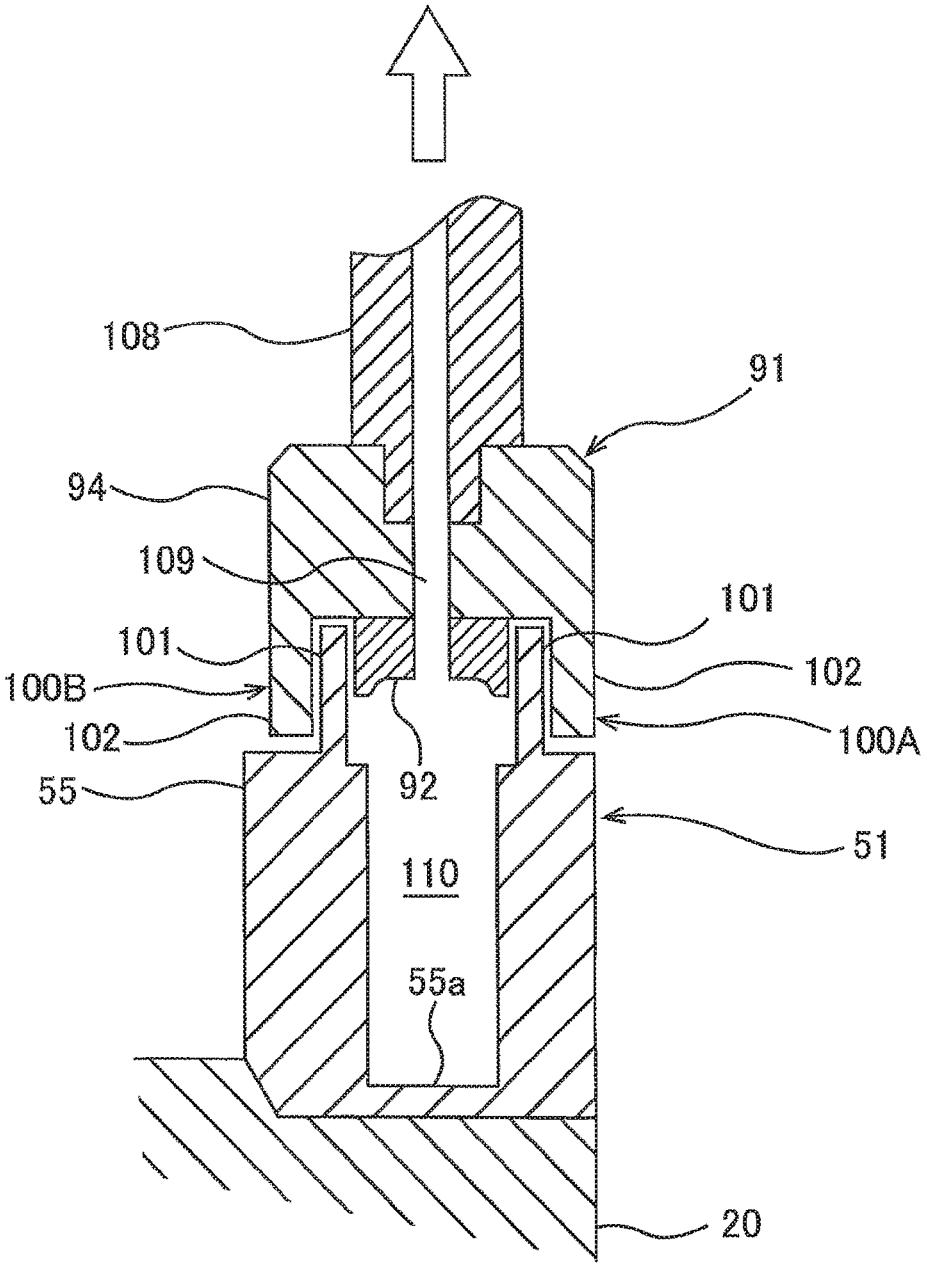
FIG. 9 is an enlarged cross-sectional view of a suction line, the stationary ring, and the rotary ring.

FIG. 9 is an enlarged cross-sectional view of the suction line 108, the stationary ring 91, and the rotary ring 51. As shown in FIG. 9, the annular rail base 94 and the circular rail 92, constituting the stationary ring 91, have a through-hole 109 that vertically extends through the stationary ring 91. This through-hole 109 communicates with a space 110 formed by the annular recess 55*a* of the roller housing 55. The rollers 52 are housed in the annular recess 55*a*.

The suction line 108 is coupled to the through-hole 109 formed in the stationary ring 91, and therefore the suction line 108 communicates with the space 110 formed by the annular recess 55*a*. As described above, since the rollers 52 make rolling contact with the circular rail 92, the wear particles may be generated. These wear particles are confined in the annular recess 55*a*. The suction line 108 sucks the wear particles out of the annular recess 55*a*, thereby removing the wear particles from the roller housing 55 (i.e. from the rotary ring 51).

The through-hole 109 formed in the circular rail 92 can possibly promote wear of the rollers 52. Therefore, the through-hole 109 is preferably located at a position where a lowest load is applied from the circular rail 92 to the rollers 52. Ideally, as shown in FIG. 8, the through-hole 109 is preferably located opposite the push rods (pressing member) 31. It is possible to provide a plurality of suction lines 108. To facilitate maintenance work, the suction line 108 is preferably removable from the stationary ring 91. In this case, a seal (e.g., O-ring) is preferably provided to seal a gap between the suction line 108 and the stationary ring 91.

Other embodiments will now be described. Constructions and operations of the following embodiments, which are the same as those of the above-described embodiment, will not be described particularly, and duplicate descriptions thereof are omitted.

Figure 10:
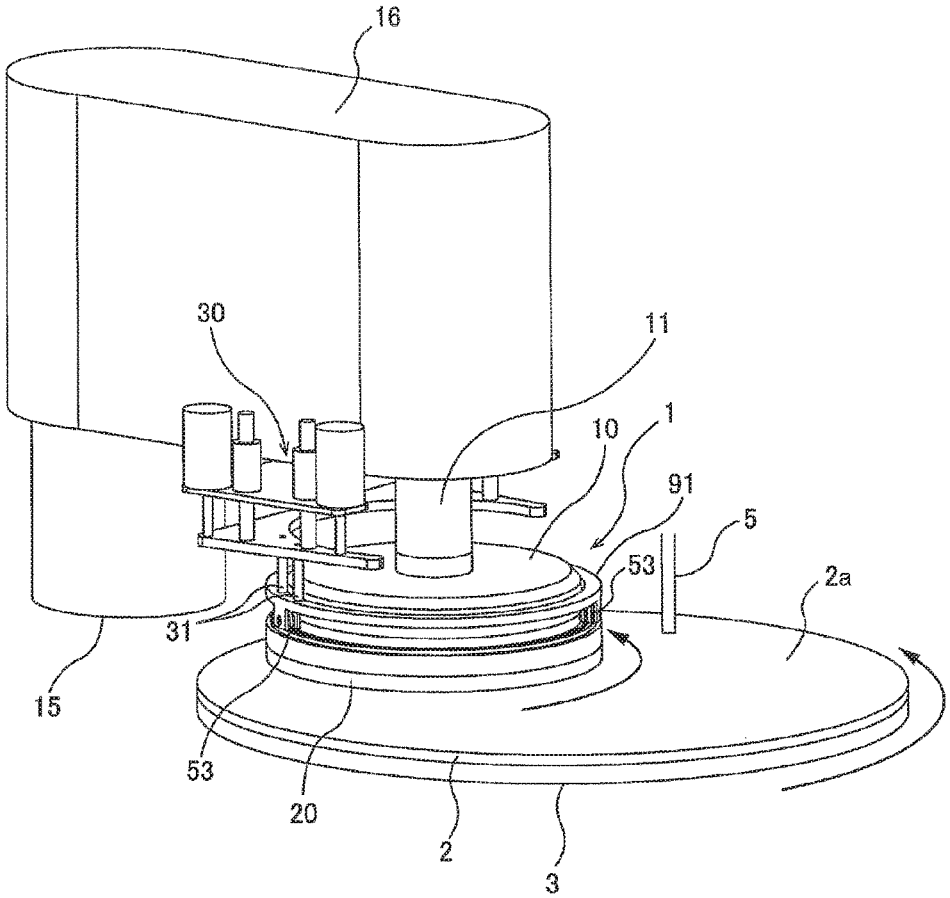
FIG. 10 is a schematic view of a polishing apparatus according to an embodiment.

FIG. 10 is a schematic view of the polishing apparatus according to another embodiment. As shown in FIG. 10, the local-load exerting device 30 is secured to the head arm 16. While the retainer ring 20 rotates about its axis during polishing, the local-load exerting device 30 does not rotate together with the retainer ring 20 and remains in a fixed position. Stationary ring 91 is disposed above the retainer ring 20. A plurality of rollers 53 are disposed between the retainer ring 20 and the stationary ring 91. The stationary ring 91 is coupled to the local-load exerting device 30.

The stationary ring 91 does not rotate and its position is fixed. The rollers 53 are held by the stationary ring 91 and make rolling contact with the rotating retainer ring 20. The local-load exerting device 30 is configured to exert a downward local load on a part of the retainer ring 20 through the stationary ring 91 and the roller 53. The downward local load is transmitted through the stationary ring 91 and the roller 53 to the retainer ring 20, and the retainer ring 20 presses the polishing surface 2*a* of the polishing pad 2. The reason for applying the downward local load to a part of the retainer ring 20 during polishing of a wafer is to positively control a profile of a peripheral portion (edge portion) of the wafer.

Figure 11:
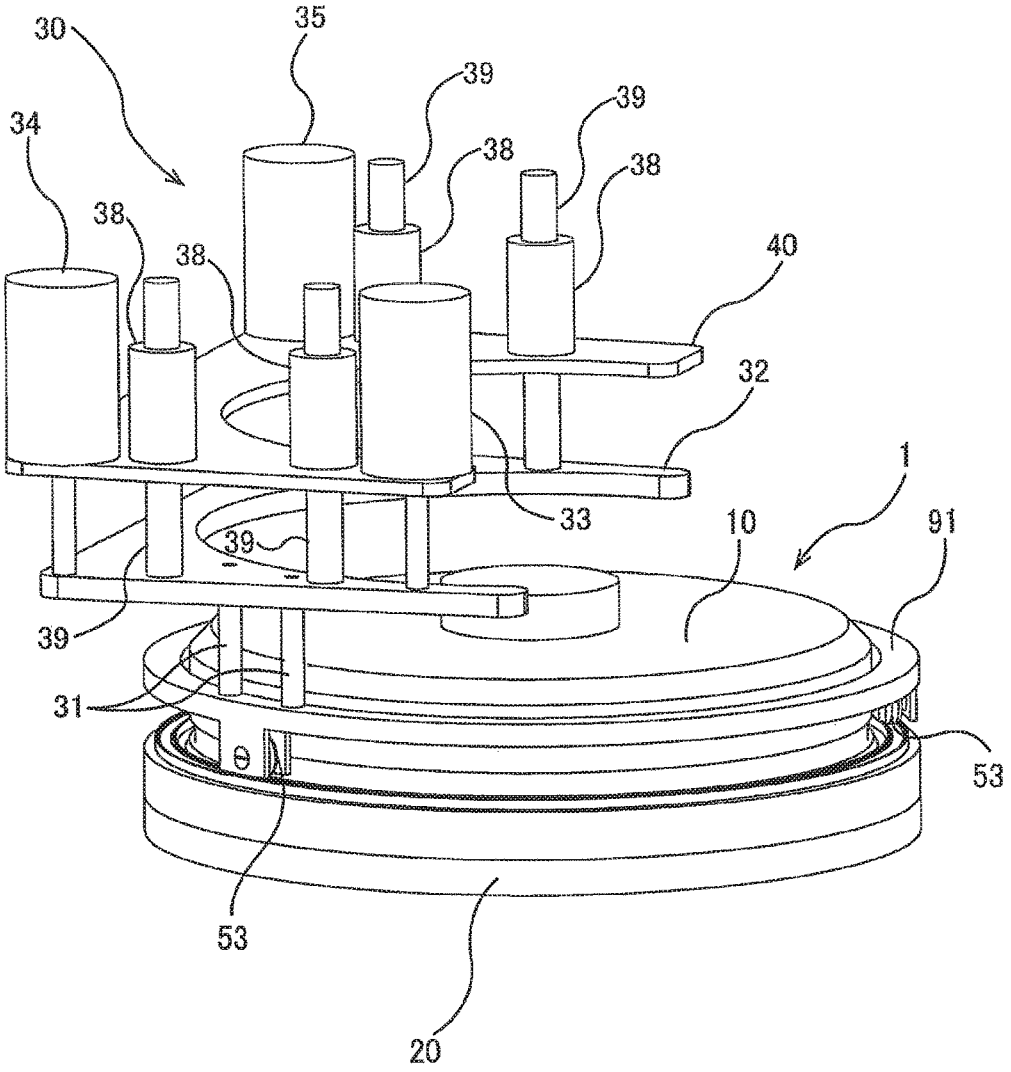
FIG. 11 is a perspective view of a local-load exerting device.

FIG. 11 is a perspective view of the local-load exerting device 30. Constructions and operations of the local-load exerting device 30, which will not be described particularly, are the same as those of the embodiment illustrated in FIG. 2, and duplicate descriptions thereof will be omitted.

The polishing head 1 rotates about its own axis, while the local-load exerting device 30, which is secured to the head arm 16, does not rotate together with the polishing head 1. Thus, while the polishing head 1 and a wafer are rotating during polishing of the wafer, the local-load exerting device 30 remains stationary in a predetermined position. The stationary ring 91 also remains stationary in a predetermined position during polishing of the wafer.

Figure 12:
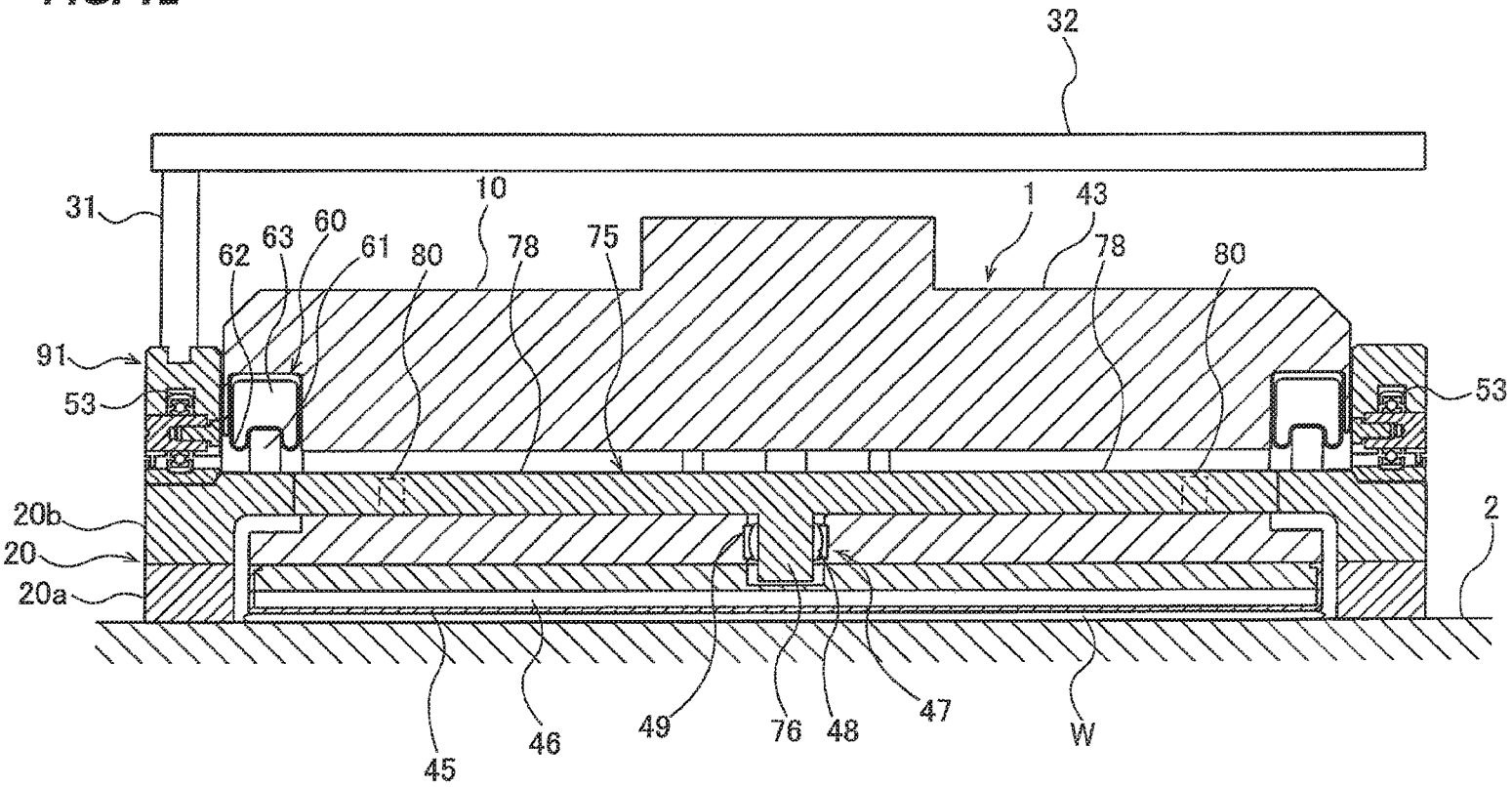
FIG. 12 is a cross-sectional view of a polishing head.

FIG. 12 is a cross-sectional view of the polishing head 1. Constructions and operations of the polishing head 1, which will not be described particularly, are the same as those of the embodiment illustrated in FIG. 3, and duplicate descriptions thereof will be omitted.

The lower ends of the push rods 31 of the local-load exerting device 30 are coupled to the stationary ring 91. The local-load exerting device 30 exerts a downward local load on the stationary ring 91 through the push rods 31. The downward local load is transmitted through the roller 53 to the retainer ring 20.

There are several reasons for the use of the two push rods 31. The first reason is to prevent the push rod 31 from tilting and becoming unstable. The second reason is to prevent the stationary ring 91 from rotating around the push rod 31. The third reason is as follows. The load point of the two push rods 31 lies at the midpoint of the two push rods 31, and thus lies inside the two pressing points of the push rods 31. This can prevent a portion of the stationary ring 91, lying opposite a pressing point, from floating.

Figure 13:
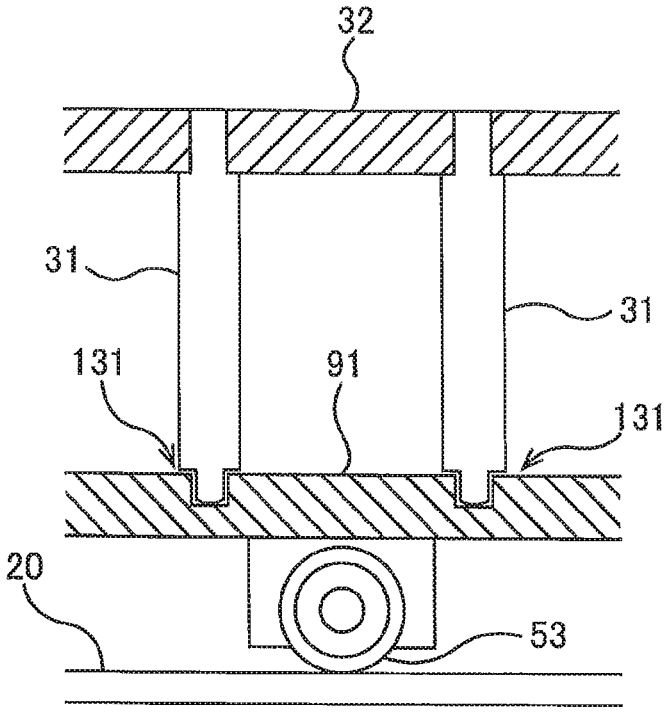
FIG. 13 is a side view of push rods, a stationary ring, and a roller.

FIG. 13 is a side view of the push rods 31, the stationary ring 91, and the roller 53. As shown in FIG. 13, two spherical bearings 131 are provided between the push rods 31 and the stationary ring 91. The two spherical bearings 131 are configured to tiltably support the two push rods 31 and each function as a tiltable coupling that can tilt in multiple directions. In this embodiment, the two push rods 31 and the two spherical bearings 131 constitute a load transmission structure.

Figure 14:
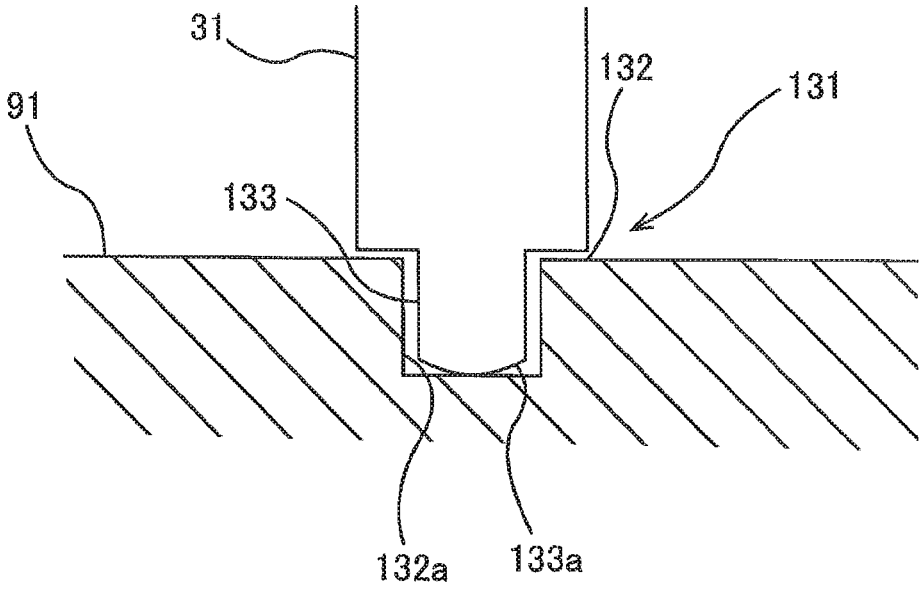
FIG. 14 is an enlarged view of a spherical bearing shown in FIG. 13.

FIG. 14 is an enlarged view of the spherical bearing 131 shown in FIG. 13. Each spherical bearing 131 includes a bearing housing 132 formed at a top of the stationary ring 91 and formed integrally with the stationary ring 91, and a cylindrical projection 133 which is in point contact with the bearing housing 132. The bearing housing 132 has a cylindrical recess 132*a*. The cylindrical projection 133 is formed at the lower end of each push rod 31 and formed integrally with each push rod 31. The cylindrical projection 133 has a spherical lower end surface 133*a*, which is in point contact with a bottom surface of the recess 132*a* of the bearing housing 132.

The cylindrical projection 133 is loosely fit in the recess 132*a* so that the cylindrical projection 133 can tilt in every direction in the recess 132*a* with the spherical lower end surface 133*a* in point contact with the bottom surface of the recess 132*a*. The push rod 31, connected integrally to the cylindrical projection 133, can therefore tilt in multiple directions. The bearing housing 132 may be provided as a separate member from the stationary ring 91. For example, the bearing housing 132 having the cylindrical recess 132*a* may be fixed to the upper surface of the stationary ring 91.

The two spherical bearings 131, each of which functions as a tiltable coupling that can tilt in multiple directions, can permit (absorb) a relative inclination between the local-load exerting device 30 and the retainer ring 20. Therefore, even when the local-load exerting device 30 and the retainer ring 20 are inclined with respect to each other, there is no generation of an excessive frictional resistance between the linear guide 38 and the linear rod 39 (see FIG. 11) and no generation of an excessive stress in the push rods 31. The local-load exerting device 30 can therefore exert the intended local load on the retainer ring 20.

Figure 15:
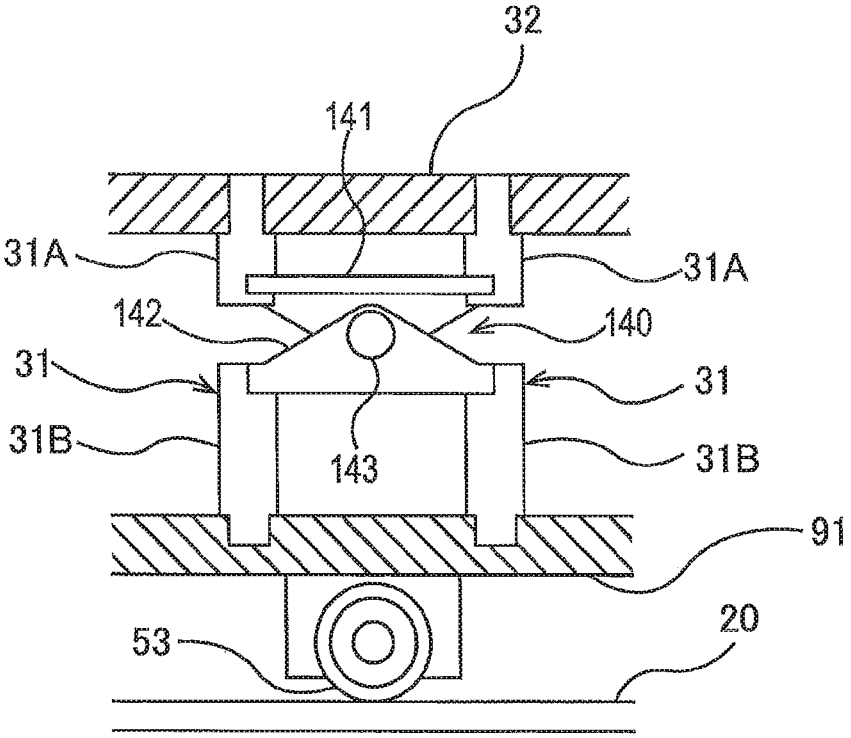
FIG. 15 is a diagram showing another embodiment of a tiltable coupling.

FIG. 15 is a diagram showing another embodiment of the tillable coupling. In the embodiment shown in FIG. 15, a tiltable coupling 140 is incorporated in the two push rods 31. More specifically, the push rods 31 are divided into upper push rods 31A and lower push rods 31B. The upper push rods 31A are coupled to the bridge 32, and the lower push rods 31B are coupled to the stationary ring 91. The tiltable coupling 140 is provided between the upper push rods 31A and the lower push rods 31B, and tiltably couples the upper push rods 31A and the lower push rods 31B to each other. In this embodiment the two push rods 31 and the tiltable coupling 140 constitute the load transmission structure.

Figure 16:
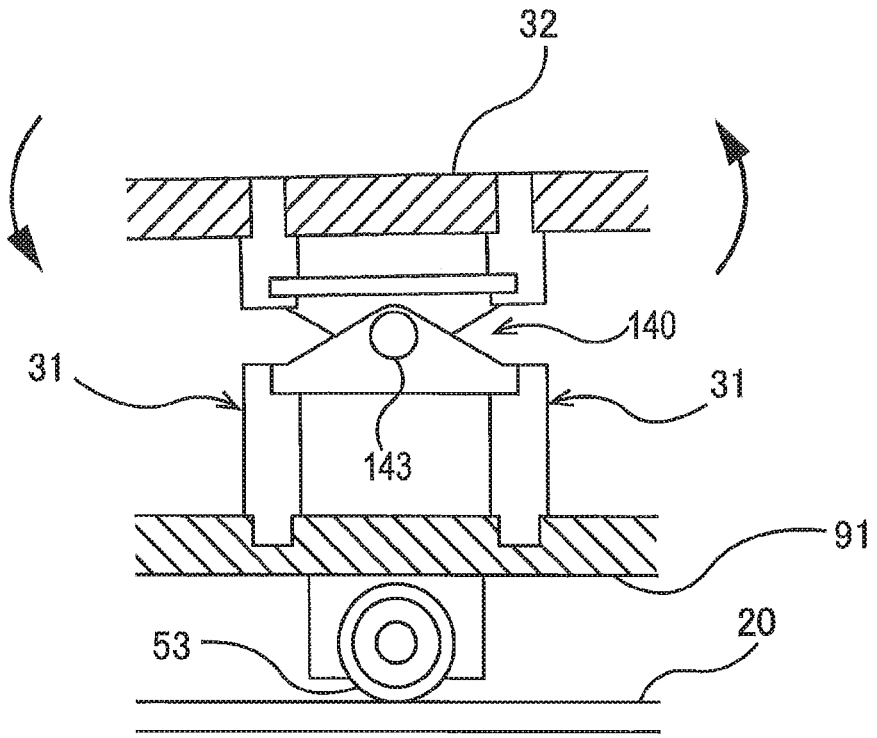
FIG. 16 is a diagram showing the tiltable coupling when tilts.

The tiltable coupling 140 includes an upper coupling member 141, a lower coupling member 142, and a pivot shaft 143 which rotatably couples the upper coupling member 141 and the lower coupling member 142. As shown in FIG. 16, the upper coupling member 141 and the lower coupling member 142 can tilt around the pivot shaft 143.

Figure 17:
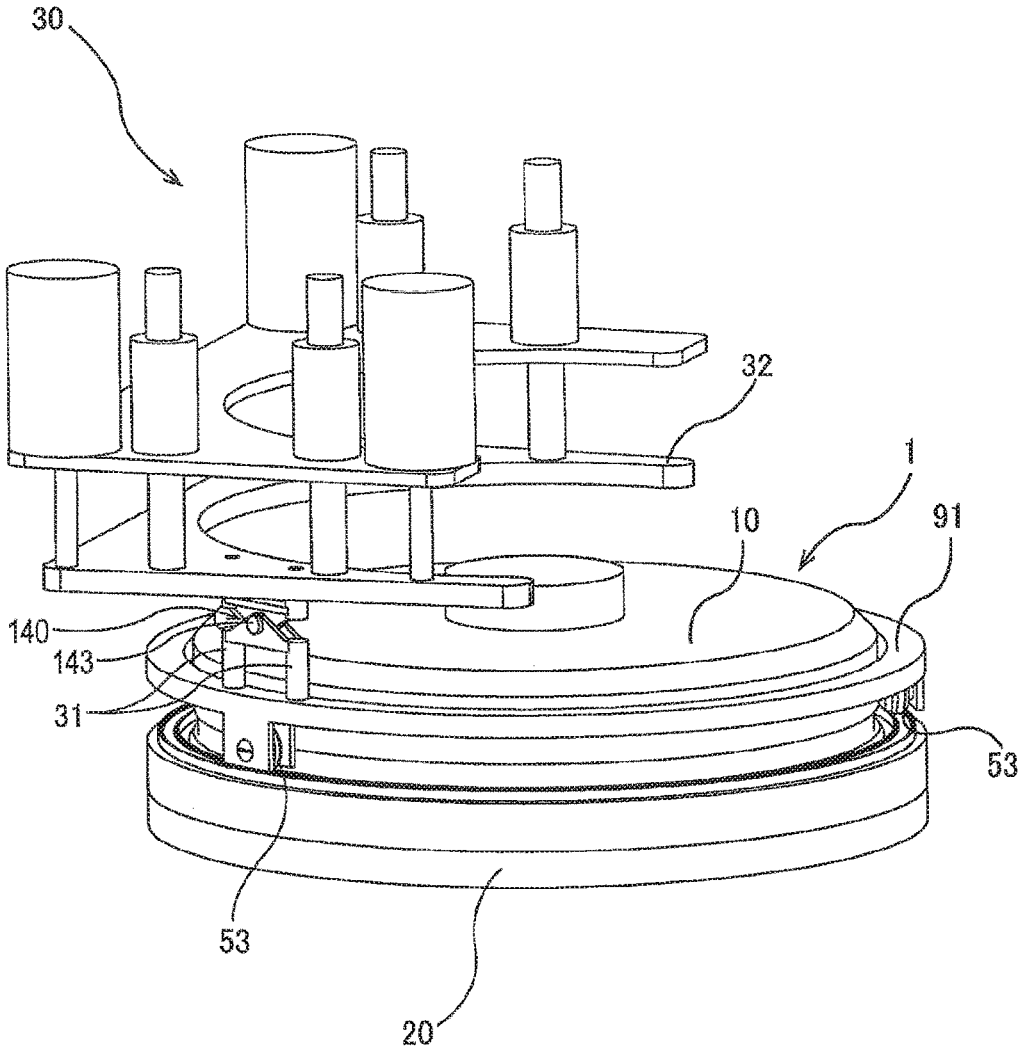
FIG. 17 is a perspective view of the local-load exerting device incorporating the tiltable coupling shown in FIG. 15, and shows the polishing head.

FIG. 17 is a perspective view of the local-load exerting device 30 incorporating the tiltable coupling 140 shown in FIG. 15, and shows the polishing head 1. The axis of the pivot shaft 143 extends in the radial direction of the retainer ring 20, and the tiltable coupling 140 can tilt only in a direction perpendicular to the axis of the pivot shaft 143. More specifically, the tiltable coupling 140 can tilt only in a direction tangential to the retainer ring 20 at a location where the two push rods 31 are coupled to the stationary ring 91.

The tiltable coupling 140 can permit (absorb) a relative inclination between the local-load exerting device 30 and the retainer ring 20. Therefore, even when the local-load exerting device 30 and the retainer ring 20 are inclined with respect to each other, there is no generation of an excessive frictional resistance between the linear guide 38 and the linear rod 39 (see FIG. 11) and no generation of an excessive stress in the push rods 31. The local-load exerting device 30 can therefore exert the intended local load on the retainer ring 20.

Figure 18:
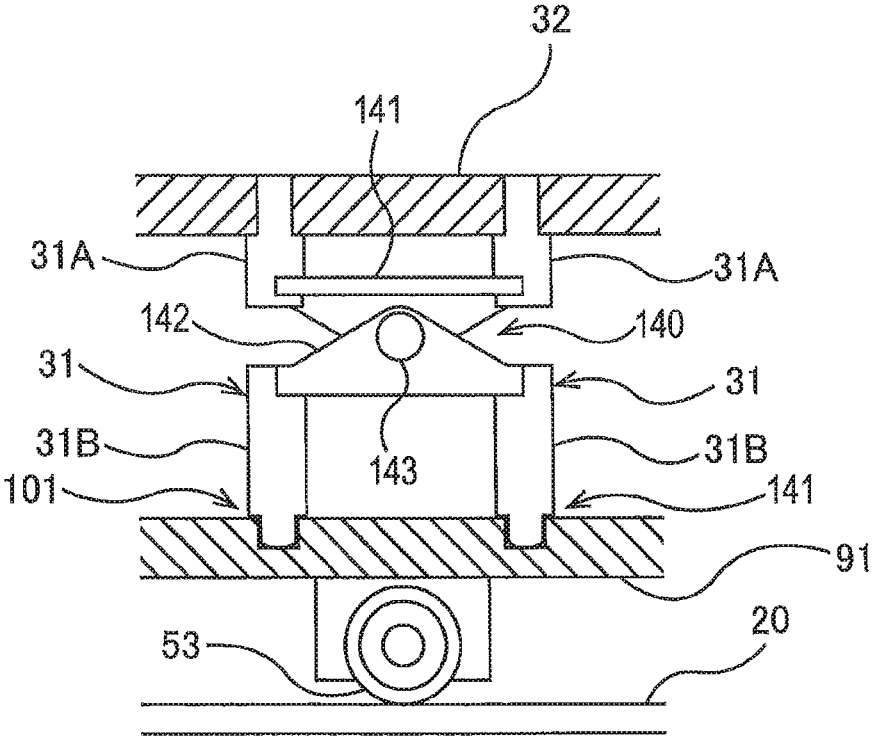
FIG. 18 is a view showing still another embodiment of a load transmission structure.

FIG. 18 is a diagram showing another embodiment of the load transmission structure. In this embodiment, the tiltable coupling 140 shown in FIG. 15 is combined with the tiltable couplings (spherical bearings) 131 shown in FIGS. 13 and 14. The load transmission structure of this embodiment is constituted by the two push rods 31, the tiltable coupling 140, and the tiltable couplings (spherical bearings) 131. The tiltable coupling 140 can tilt only in a direction tangential to the retainer ring 20 at the location where the two push rods 31 are coupled to the stationary ring 91, while the tiltable couplings 131 can tilt in every direction through 360 degrees. The other constructions of this embodiment are the same as the constructions shown in FIG. 15, and hence duplicate descriptions thereof are omitted.

Figure 19:
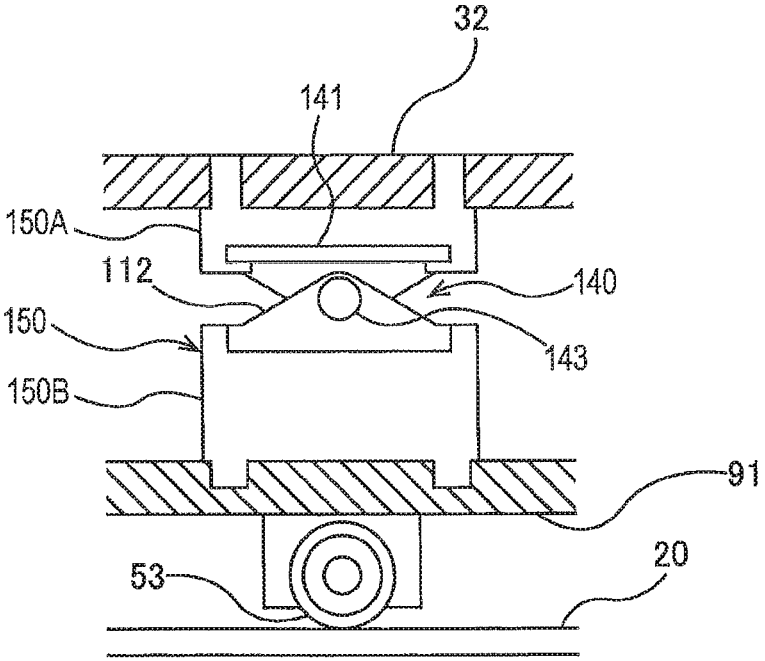
FIG. 19 is a view showing still another embodiment of the load transmission structure.

FIG. 19 is a diagram showing yet another embodiment of the load transmission structure. In this embodiment, one pressing block 150 as a pressing member is used instead of the two push rods 31. The tiltable coupling 140 is incorporated in the pressing block 150. More specifically, the pressing block 150 is divided into an upper pressing block 150A and a lower pressing block 150B. The upper pressing block 150A is coupled to the bridge 32, and the lower pressing block 150B is coupled to the stationary ring 91. The tiltable coupling 140 is provided between the upper pressing block 150A and the lower pressing block 150B, and tiltably couples the upper pressing block 150A and the lower pressing block 150B. The other constructions of this embodiment are the same as the constructions shown in FIG. 15, and hence duplicate description thereof are omitted.

Figure 20:
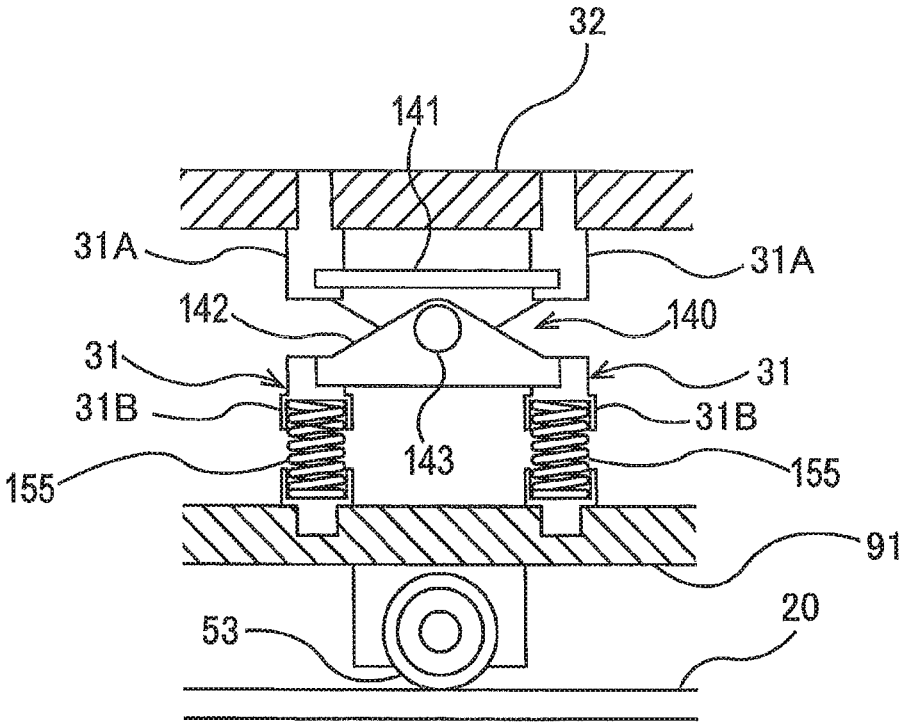
FIG. 20 is a view showing still another embodiment of the load transmission structure.

FIG. 20 is a diagram showing yet another embodiment of the load transmission structure. In this embodiment, a spring 155 as a vibration absorber is incorporated in each of the two push rods 31. The other constructions of this embodiment are the same as the constructions shown in FIG. 15, and hence duplicate description thereof are omitted.

The springs 155 are incorporated in the lower push rods 31B, and configured to absorb vertical vibration of the retainer ring 20 caused, for example, by the surface irregularities of the polishing pad 2. The springs 155 may be incorporated in the upper push rods 31A. According to this embodiment, the tiltable coupling 140 can permit (absorb) a relative inclination between the local-load exerting device 30 and the retainer ring 20, and the springs 155 as vibration absorbers can absorb the vertical vibration of the retainer ring 20. The local-load exerting device 30 can therefore apply the intended local load to the retainer ring 20.

Figure 21:
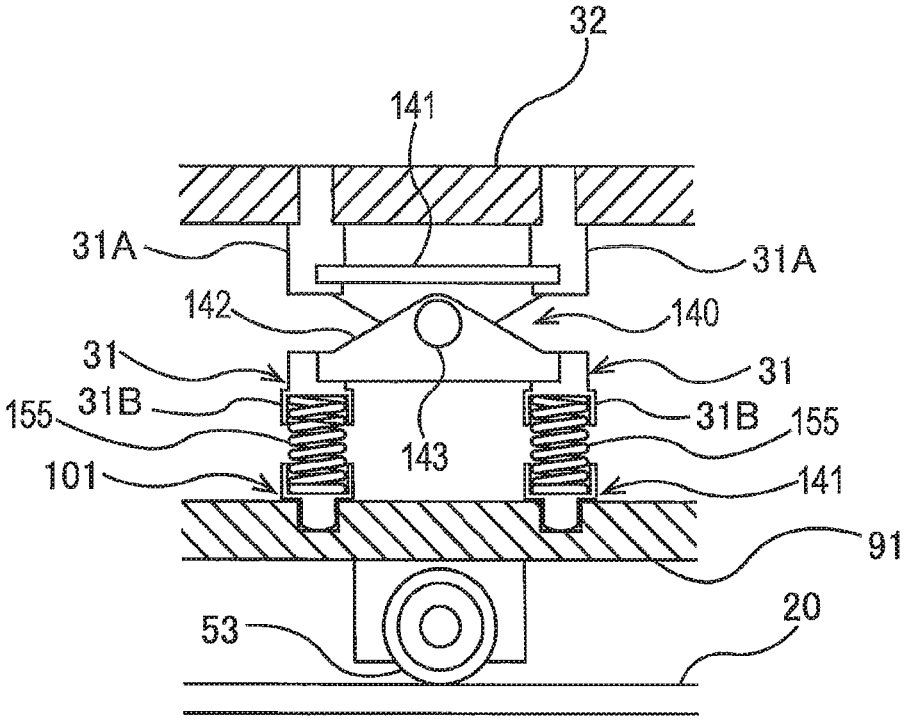
FIG. 21 is a view showing still another embodiment of the load transmission structure.
Figure 22:
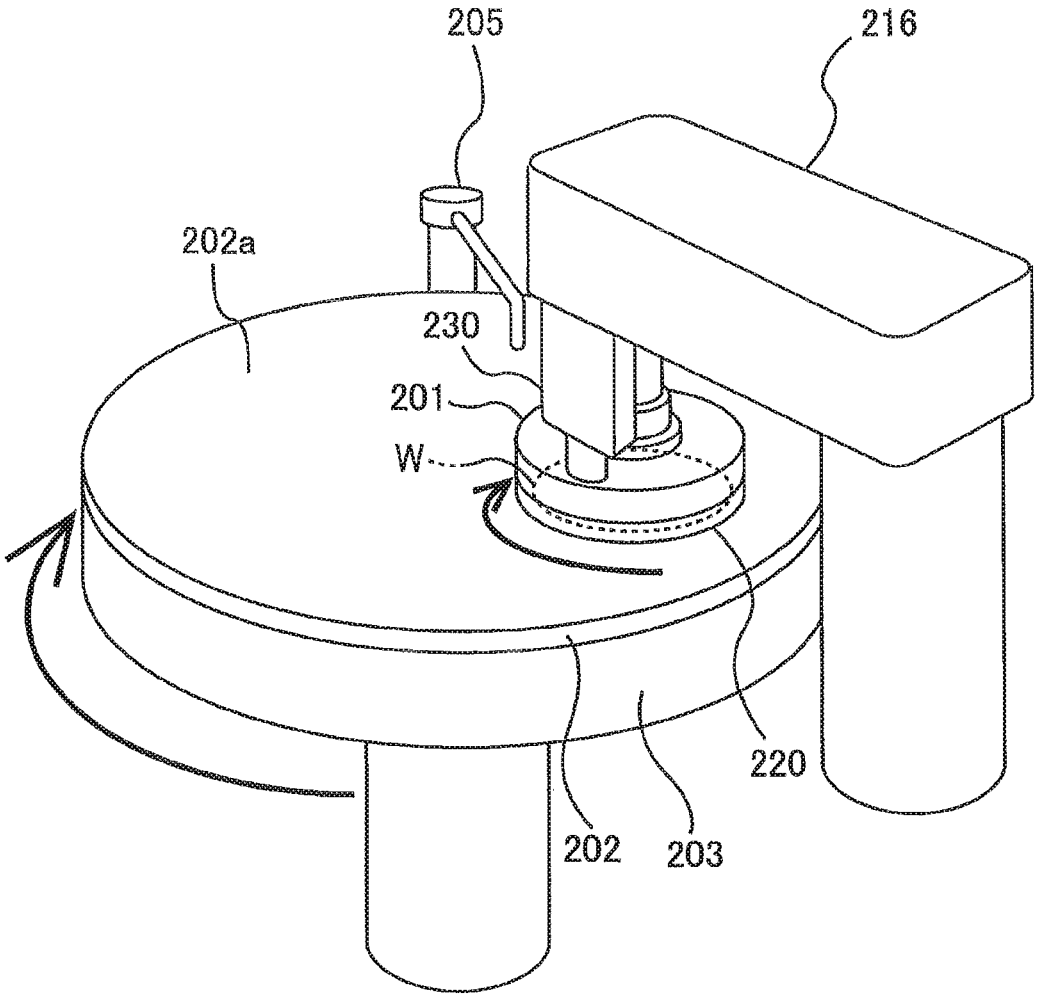
FIG. 22 is a schematic view of a polishing apparatus for performing CMP.
Figure 23:
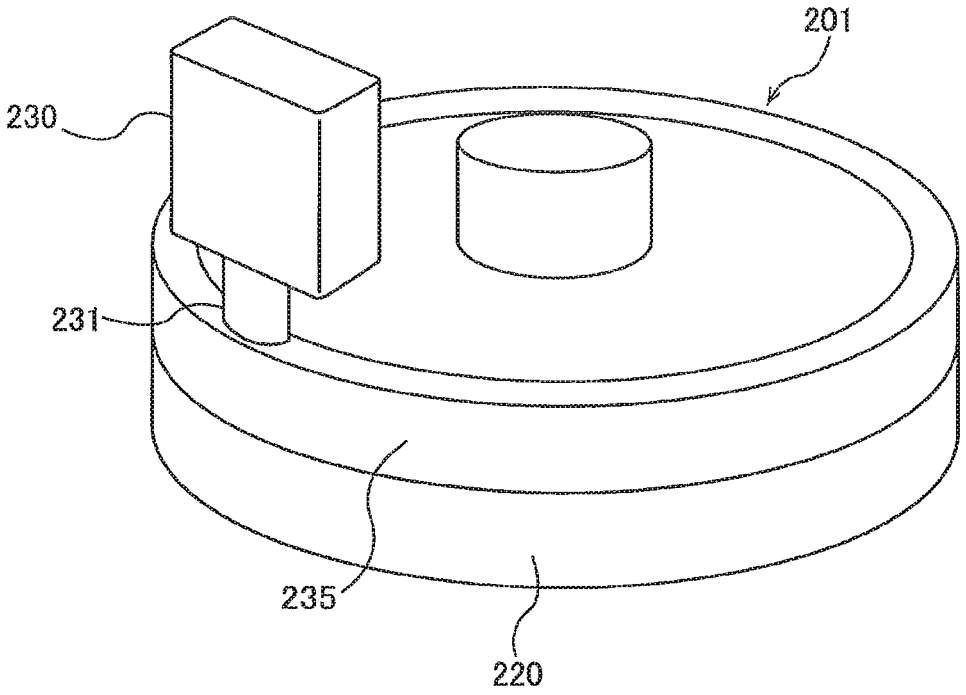
FIG. 23 is a perspective view of a conventional local-load exerting device and a polishing head.

FIG. 21 is a diagram showing yet another embodiment of the load transmission structure. In this embodiment the tiltable coupling 140 shown in FIG. 15 is combined with the tiltable couplings (spherical bearings) 131 shown in FIGS. 13 and 14, and with the springs 155 shown in FIG. 20. The other constructions of this embodiment are the same as the constructions shown in FIG. 15, and hence duplicate description thereof are omitted.

In the embodiments shown in FIGS. 20 and 21, instead of the springs 155, rubber may be used as the vibration absorber.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims.

What is claimed is:

1. A polishing apparatus comprising:

a head body having a substrate holding surface configured to press a substrate against a polishing surface while rotating the substrate;

a retainer ring surrounding the substrate holding surface and configured to press the polishing surface while rotating together with the head body;

a stationary ring disposed above the retainer ring, the stationary ring being not rotatable together with the retainer ring; and a local-load exerting device configured to apply a local load to a part of the retainer ring through the stationary ring, the local-load exerting device having a load transmission structure coupled to the stationary ring, the load transmission structure including a tiltable coupling configured to tilt only in a direction tangential to the retainer ring at a location where the load transmission structure is coupled to the stationary ring which permits a relative inclination between the local-load exerting device and the retainer ring, wherein the tiltable coupling includes an upper coupling member, a lower coupling member, and a pivot shaft which rotatably couples the upper coupling member to the lower coupling member.

2. The polishing apparatus according to claim 1, wherein the load transmission structure includes:

a pressing member coupled to the stationary ring; and the tiltable coupling fixed to the pressing member.

3. The polishing apparatus according to claim 1, wherein the load transmission structure further includes a vibration absorber.

4. The polishing apparatus according to claim 3, wherein the vibration absorber comprises a spring.

5. The polishing apparatus according to claim 3, wherein the vibration absorber is made of rubber.

6. The polishing apparatus according to claim 1, wherein the load transmission structure includes two push rods for transmitting the local load, the local-load exerting device includes:

a load generator; and a bridge to which the load generator and both of the two push rods are coupled.

7. The polishing apparatus according to claim 6, wherein the local-load exerting device further includes:

a guide rod coupled to the bridge; and a linear guide slidably supporting the guide rod.

8. The polishing apparatus according to claim 1, wherein the local-load exerting device is not rotatable together with the retainer ring.

* * * * *